US007966175B2

(12) United States Patent
Xie

(10) Patent No.: US 7,966,175 B2
(45) Date of Patent: Jun. 21, 2011

(54) FAST LATTICE VECTOR QUANTIZATION

(75) Inventor: Minjie Xie, Newton, MA (US)

(73) Assignee: Polycom, Inc., Pleasanton, CA (US)

( * ) Notice: Subject to any disclaimer, the term of this patent is extended or adjusted under 35 U.S.C. 154(b) by 1047 days.

(21) Appl. No.: 11/550,682

(22) Filed: Oct. 18, 2006

(65) Prior Publication Data

US 2008/0097755 A1 Apr. 24, 2008

(51) Int. Cl.
*G10L 19/02* (2006.01)

(52) U.S. Cl. ..... 704/229; 704/230; 704/222; 704/224; 704/243; 375/240.07

(58) Field of Classification Search ..... 704/229, 704/230, 222, 224, 243, 200.1, 500–504; 382/253; 375/240.07
See application file for complete search history.

(56) References Cited

U.S. PATENT DOCUMENTS

| | | | | |
|---|---|---|---|---|
| 5,060,268 | A | 10/1991 | Asakawa et al. | |
| 5,317,672 | A | 5/1994 | Crossman et al. | |
| 5,664,057 | A | 9/1997 | Crossman et al. | |
| 5,675,590 | A | 10/1997 | Alamouti | |
| 5,825,419 | A | 10/1998 | Mishima et al. | |
| 5,859,788 | A | 1/1999 | Hou | |
| 5,883,981 | A * | 3/1999 | Li et al. | 382/253 |
| 5,911,130 | A | 6/1999 | Shimizu et al. | |
| 5,924,064 | A | 7/1999 | Helf | |
| 6,018,707 | A | 1/2000 | Nishiguchi et al. | |
| 6,101,464 | A | 8/2000 | Serizawa | |
| 6,242,936 | B1 | 6/2001 | Ho et al. | |
| 6,351,730 | B2 | 2/2002 | Chen | |
| 6,424,936 | B1 | 7/2002 | Shen et al. | |
| 6,795,805 | B1 * | 9/2004 | Bessette et al. | 704/223 |
| 6,915,255 | B2 | 7/2005 | Watanabe | |
| 7,039,581 | B1 | 5/2006 | Stachurski et al. | |
| 7,106,794 | B2 * | 9/2006 | Ungerboeck et al. | 375/240 |
| 7,315,815 | B1 | 1/2008 | Gersho et al. | |
| 7,460,150 | B1 | 12/2008 | Coughlan et al. | |
| 7,587,314 | B2 * | 9/2009 | Vasilache et al. | 704/222 |
| 7,613,605 | B2 | 11/2009 | Funakoshi | |
| 7,627,481 | B1 | 12/2009 | Kuo et al. | |
| 2002/0154247 | A1 | 10/2002 | Ghosh et al. | |
| 2003/0122692 | A1 | 6/2003 | Roeckner et al. | |

(Continued)

FOREIGN PATENT DOCUMENTS

CN 1659785 A 8/2005

(Continued)

OTHER PUBLICATIONS

"CR2325 Data Sheet," Renata Batteries, Oct. 2001.

(Continued)

*Primary Examiner* — Vijay B Chawan
(74) *Attorney, Agent, or Firm* — Wong, Cabello, Lutsch, Rutherford & Brucculeri, LLP

(57) ABSTRACT

Methods, devices, and systems for coding and decoding audio are disclosed. Digital samples of an audio signal are transformed from the time domain to the frequency domain. The resulting transform coefficients are coded with a fast lattice vector quantizer. The quantizer has a high rate quantizer and a low rate quantizer. The high rate quantizer includes a scheme to truncate the lattice. The low rate quantizer includes a table based searching method. The low rate quantizer may also include a table based indexing scheme. The high rate quantizer may further include Huffman coding for the quantization indices of transform coefficients to improve the quantizing/coding efficiency.

22 Claims, 8 Drawing Sheets

U.S. PATENT DOCUMENTS

| | | | | |
|---|---|---|---|---|
| 2004/0030548 | A1 | 2/2004 | El-Maleh | |
| 2005/0285764 | A1* | 12/2005 | Bessette et al. | 341/143 |
| 2007/0055509 | A1* | 3/2007 | Vasilache et al. | 704/229 |
| 2007/0118368 | A1 | 5/2007 | Suzuki et al. | |
| 2007/0168197 | A1* | 7/2007 | Vasilache | 704/503 |
| 2007/0194961 | A1 | 8/2007 | Heeb | |
| 2009/0175550 | A1* | 7/2009 | Taleb | 382/253 |

FOREIGN PATENT DOCUMENTS

| | | | |
|---|---|---|---|
| JP | 10-97300 | A | 4/1989 |
| JP | 10-124092 | | 5/1998 |
| JP | 10-174096 | | 6/1998 |
| JP | 2000-134105 | | 5/2000 |
| JP | 2001-502073 | | 2/2001 |
| JP | 20020094992 | | 3/2002 |
| JP | 2002532765 | | 10/2002 |
| JP | 2005-528839 | A | 9/2005 |
| JP | 2006510922 | | 3/2006 |
| JP | 2006-145782 | | 8/2006 |
| JP | 2007523530 | | 8/2007 |
| JP | 2007525707 | | 9/2007 |
| TW | 272341 | | 8/2005 |
| TW | 241558 | | 10/2005 |
| TW | 200604536 | A1 | 2/2006 |
| TW | 200609902 | | 5/2006 |
| WO | 9815945 | A1 | 4/1998 |
| WO | 0036754 | A1 | 6/2000 |
| WO | 03103151 | A1 | 12/2003 |
| WO | WO 03103151 | A1 * | 12/2003 |
| WO | 2005-076260 | A1 | 8/2005 |
| WO | 2005078706 | A1 | 8/2005 |
| WO | 2005086161 | A2 | 9/2005 |
| WO | 2006/008817 | A1 | 1/2006 |

OTHER PUBLICATIONS

Ericksson, Thomas and Erik Agrell, "Lattice-Based Quantization, Part II," Technical Report No. 18, Oct. 1996, Department of Information Theory, Chalmers University of Technology, Goteborg, Sweden.

"MPEG-4 AAC-LD Low Delay High Quality Audio Coding," Sep. 2004, Institut Integrierte Schaltungen, Erlangen, Germany.

Numerical Recipes in C: The Art of Scientific Computing, 1988-1992, pp. 903-910, Cambridge University Press.

"ITU-T Recommendation G.722 Appendix II: Series G: Transmission Systems and Media," Mar. 1987, International Telecommunications Union.

"ITU-T Recommendation G.722: General Aspects of Digital Transmission Systems," 1988 and 1993, International Telecommunications Union.

"ITU-T Recommendation G.722 Annex A: General Aspects of Digital Transmission Systems," Mar. 1993, International Telecommunications Union.

"ITU-T Recommendation G.722.1: Series G: Transmission Systems and Media, Digital Systems and Networks," Sep. 1999, International Telecommunications Union.

"ITU-T Recommendation G.722.1: Series G: Transmission Systems and Media, Digital Systems and Networks," May 2005, International Telecommunications Union.

Jin, Changyou and Heng-Ming Tai, "Fast Algorithm for Computing Modulated Lapped Transform," Electronic Letters, Jun. 7, 2001, pp. 796-797, vol. 37.

"ITU Approves Polycom Siren14 as New International Standard—ITU Tests Show Super Wideband Audio Better than MPEG4," Apr. 12, 2005, [Retrieved Sep. 12, 2006], Retrieved from the Internet: http://www.polycom.com/common/pw_cmp_printScreen/0,,pw-10112,FF.html.

De Queiroz, Ricardo, "On Lapped Transforms," Doctoral Dissertation for the University of Texas at Arlington, Dec. 1999, Arlington, TX.

Schindler, Michael, "Practical Huffman Coding," [Retrieved Jan. 14, 2005], Retrieved from the Internet: http://www.compressconsult.com/huffman.

Siren Wideband Audio Codec License Agreement. [Retrieved Sep. 11, 2006] Retrieved from the Internet at http://www.polycom.com.

Tanaka, Toshihisa, "Lapped Transforms and Their Applications in Image Processing," Dissertation, Feb. 2002, Department of International Development Engineering, Graduate School of Science and Engineering, Tokyo Institute of Technology.

Malvar, H. S., "Signal Processing with Lapped Transforms," Norwood, MA: Artech House, 1992, pp. 175-218.

Jayant, N. S. and P. Noll, "Digital Coding of Waveforms: Principles and Applications to Speech and Video," pp. 510-535, Englewood Cliffs, NJ: Prentice-Hall, 1984.

Hou, Z., W. Dou and A. Dong, "New Window-switching Criterion of Audio Compression," Proceedings of the 2001 IEEE 4th Workshop on Multimedia Signal Processing, pp. 319-323, Oct. 2001.

Linde, Y., A. Buzo and R. M. Gray, "An Algorithm for Vector Quantizer Design," IEEE Trans. Communications, vol. 28, No. 1, pp. 84-95, Jan. 1980.

Conway, J. H. and N. J. A. Sloane, "A Fast Encoding Method for Lattice Codes and Quantizers," IEEE Trans. Information Theory, vol. 29, No. 6, pp. 820-824, Nov. 1983.

Conway, J. H. and N. J. A. Sloane, "Fast Quantizing and Decoding Algorithms for Lattice Quantizers and Codes," IEEE Trans. Information Theory, vol. 28, No. 2, pp. 227-232, Mar. 1982.

Lamblin, C. and J.-P. Adoul, "Algorithme de Quantification Vectorielle Spherique a Partir du Reseau de Gosset d'ordre 8," Annales des Telecommunications, 43, No. 3-4, pp. 172-186, 1988.

Huffman, D. A., "A Method for the Constructions of Minimum-Redundancy Codes," Proceedings of IRE, vol. 40, pp. 1098-1011, Sep. 1952.

Conway, J. H. and N. J. A. Sloane. "Sphere Packings, Lattices and Groups," pp. 56-62, 117-127, 445-450, Springer-Verlag New York, Inc., New York, NY, 1999.

Minjie Xie, et al., "Embedded Algebraic Vector Quantizers (EAVQ) With Application to Wideband Speech Coding", 1996 IEEE International Conference on Acoustics, Speech, and Signal Processing, Atlanta, May 7-10, 1996, vol. 1 Conf. 21, pp. 240-243.

Stephanie Ragot, et al., "Wideband LSF Quantization by Generalized Voronoi Codes", Eurospeech 2001, vol. 4, Sep. 3, 2001, pp. 2319-2322.

European Search Report dated Jan. 17, 2008.

Kumaraswamy, Krishna and Megalooikonomou, Vasileios, "Fractal Dimension and Vector Quantization"; http://citeseerx.ist.psu.edu/viewdoc/summary?doi=10.1.1.58.9362; Year 2003.

Malvar, Henrique, "A Modulated Complex Lapped Transform and its Applications to Audio Processing," IEEE International Conference on Acoustics, Speech, and Signal Processing, pp. 1-8, May 1999.

"Siren/G.722.1 FAQs", http//www.polycom.com/common/pw_cmp_printScreen/0,, pw-1234.FF.html, generated Sep. 12, 2006.

"Siren14 TM/G.722.1C Info", http://www.polycom.com/common/pw_cmp_printScreen/0,,pw-10713,FF.html, generated Sep. 12, 2006.

Raad, Mohammed, Alfred Mertins and Ian Burnett, "Audio Compression Using the MLT and SPIHT," pp. 128-132, University of Wollongong, Australia, Jan. 2002, http://www.isip.uni-luebeck.de/uploads/tx_wapublications/raad-audio-02.pdf.

"Huffman Coding", Page last modified Jan. 2, 2005; pp. 1-5; http://en.wikipedia.org/wiki/Huffman_coding.

Hou Steve, "Principal Components and Wavelet Transforms for Data Compression," The Aerospace Corporation; electronic version of file generated on Jan. 14, 2005.

Minjie Xie, et al., "Embedded Algebraic Vector Quantizers (EAVQ) With Application to Wideband Speech Coding," 1996 IEEE International Conference on Acoustics, Speech and Signal Processing, Atlanta, May 7-10, 1996, vol. 1 Conf. 21, pp. 240-243.

Stephanie Ragot, et al. "Wideband LSF Quantization by Generalized Voronoi Codes," Eurospeech 2001, vol. 4, Sep. 3, 2001, pp. 2319-2322.

Lamblin, C. and J.-P Adoul, "Algorithme de Quantification Vectorielle Spherique a Partir du Reseau de Gosset d'ordre 8," Annales des Telecommunications, 43, No. 3-4, pp. 172-186, 1988.

Japan Patent Office Official Action—English Translation dated Nov. 30, 2010.

Taiwan Patent Office Action dated Dec. 8, 2010 for Taiwan Patent App. # 096132103—English translation.
Translation of First Office Action dated Oct. 27, 2010 received for corresponding Chinese patent application No. 2007101671287.
European Office Action EP application No. 07019186.1-2225, Jan. 28, 2008.
Japanese Office Action (App. # 2007-269121) English translation dated Dec. 7, 2010.
Decision to Grant dated Jan. 30, 2010 for Korean Patent App. # 10-2007-0099144 English translation.
European Second Examination Report EP application No. 07019186.1-2225, Jun. 5, 2010.
Translation of First Office Action dated Oct. 27, 2010 received for corresponding Chinese patent application No. 2007101671287.

* cited by examiner

FAST LATTICE VECTOR QUANTIZATION

CROSS-REFERENCE TO RELATED APPLICATIONS

The present invention is related to commonly owned and co-pending U.S. application Ser. No. 11/550,629 entitled "Dual-Transform Coding of Audio Signals" filed on even date herewith. The contents of said application are hereby incorporated by reference.

BACKGROUND OF THE INVENTION

1. Field of the Invention

The present invention relates generally to encoding and decoding audio signals, and more particularly, to encoding and decoding audio signals with an audio bandwidth up to approximately 22 kHz using fast lattice vector quantization.

2. Description of the Related Art

Audio signal processing is utilized in many systems that create sound signals or reproduce sound from such signals. With the advancement of digital signal processors (DSPs), many signal processing functions are performed digitally. To do so, audio signals are created from acoustic waves, converted to digital data, processed for desired effects, converted back to analog signals, and reproduced as acoustic waves.

The analog audio signals are typically created from acoustic waves (sound) by microphones. The amplitude of the analog audio signal is sampled at a certain frequency, and the amplitude is converted to a number that represents the amplitude. The typical sampling frequency is approximately 8 kHz (i.e., sampling 8,000 times per second), 16 kHz to 196 kHz, or something in between. Depending on the quality of the digitized sound, each sample of the sound may be digitized using 8 bits to 128 bits or something in between. To preserve high quality sound, it may take a lot of bits. For example, at a very high end, to represent one second of sound at a 196 kHz sampling rate and 128 bits per sample, it may take 128 bits×192 kHz=24 Mbit=3 MB. For a typical song of 3 minutes (180 seconds), it takes 540 MB. At the low end, in a typical telephone conversation, the sound is sampled at 8 kHz and digitized at 8 bits per sample, it still takes 8 kHz×8 bit=64 kbit/second=8 kB/second. To make the digitized sound data easier to use, store and transport, they are typically encoded to reduce their sizes without reducing the sound quality. When they are about to be reproduced, they are decoded to restore the original digitized data.

There are various ways that have been suggested to encode or decode audio signals to reduce their size in the digital format. A processor or a processing module that encodes and decodes a signal is generally referred to as a codec. Some are lossless, i.e., the decoded signal is exactly the same as the original. Some are lossy, i.e., the decoded signal is slightly different from the original signal. A lossy codec can usually achieve more compression than a lossless codec. A lossy codec may take advantage of some features of human hearing to discard some sounds that are not readily perceptible by humans. For most humans, only sound within an audio spectrum between approximately 20 Hz to approximately 20 kHz is perceptible. Sound with frequency outside this range is not perceived by most humans. Thus, when reproducing sound for human listeners, producing sound outside the range does not improve the perceived sound quality. In most audio systems for human listeners, sounds outside the range are not reproduced. In a typical public telephone system, only frequencies within approximately 300 Hz to approximately 3000 Hz are communicated between the two telephone sets. This reduces data transmission.

One popular method for encoding/decoding music is the method used in an MP3 codec. A typical music CD can store about 40 minutes of music. When the same music is encoded with an MP3 encoder at comparable acoustic quality, such a CD may store 10-16 times more music.

ITU-T (International Telecommunication Union Telecommunication Standardization Sector) Recommendation G.722 (1988), entitled "7 kHz audio-coding within 64 kbit/s," which is hereby incorporated by reference, describes a method of 7 kHz audio-coding within 64 kbit/s. ISDN lines have the capacity to transmit data at 64 kbit/s. This method essentially increases the bandwidth of audio through a telephone network using an ISDN line from 3 kHz to 7 kHz. The perceived audio quality is improved. Although this method makes high quality audio available through the existing telephone network, it typically requires ISDN service from a telephone company, which is more expensive than a regular narrow band telephone service.

A more recent method that is recommended for use in telecommunications is the ITU-T Recommendation G.722.1 (1999), entitled "Coding at 24 and 32 kbit/s for hands-free operation in systems with low frame loss," which is hereby incorporated herein by reference. This Recommendation describes a digital wideband coder algorithm that provides an audio bandwidth of 50 Hz to 7 kHz, operating at a bit rate of 24 kbit/s or 32 kbit/s, much lower than the G.722. At this data rate, a telephone having a regular modem using the regular analog phone line can transmit wideband audio signals. Thus, most existing telephone networks can support wideband conversation, as long as the telephone sets at the two ends can perform the encoding/decoding as described in G.722.1.

BRIEF SUMMARY OF THE INVENTION

It is desirable to have full spectrum sound through a telephone, such that a telephone conversation is almost the same as face-to-face conversation in terms of sound quality. It is desirable to have a method that can improve the sound quality, or reduce the data load, or both.

The present invention discloses systems, methods, and devices that improve the efficiency of an audio codec i.e., improve sound quality and reduce data load in a transmission channel or a storage medium. One embodiment of the present invention applies at least two MLTs (Modulated Lapped Transforms) to the input audio signals. One low frequency MLT uses a frame of approximately 20 ms and one high frequency MLT uses four frames of approximately 5 ms each. The low frequency MLT may be similar to the one described in the G.722.1, while the high frequency MLT provides higher resolution at high frequencies. The dual transform yields better reproduction of transients for higher frequencies as compared to a single transform.

The MLT coefficients may be grouped into sub-frames and then groups with different lengths. Each amplitude envelope of a sub-frame may be quantized by a logarithmic scalar quantizer and the MLT coefficients may be quantized with a multidimensional lattice vector. A fast lattice vector quantizer according to various embodiments of the present disclosure improves the quantization efficiency and accuracy over a scalar quantizer without the usual problems associated with lattice vector quantization. Various embodiments of the present disclosure further improve quantization and coding by using two different quantization schemes, one for higher rate quantization and one for lower rate quantization.

Various embodiments of the present disclosure further improve the quantization encoding by dynamically determining whether Huffman coding is to be utilized for coding the amplitude envelopes and coefficient indices. For each of the four groups, Huffman coding may be utilized only when it can reduce the overall the bits required for coding all of the coefficient indices within the group. Otherwise, Huffman coding may not be used in order to reduce unnecessary computation cost.

In accordance with various embodiments of the present disclosure, a quantization method for use in coding audio signals is provided. The method may include using a first lattice vector quantizer to quantize transform coefficients at rates greater than 1 bit per coefficient and using a second lattice vector quantizer to quantize transform coefficients at a rate of 1 bit per coefficient.

For quantizing transform coefficients at rates greater than 1 bit per coefficient, the method may include constructing a codebook from a truncated lattice, wherein the lattice comprises a multi-dimensional lattice of all codevectors having integer coordinates with an even sum and quantizing outlier source vectors lying outside of the truncated lattice.

For quantizing transform coefficients at a rate of 1 bit per coefficient, the method may include constructing a codebook from a lattice comprising a multi-dimensional lattice of all codevectors falling on concentric spheres and quantizing each codevector.

In accordance with various embodiments of the present disclosure, a method of encoding an audio signal is provided. The method may include transforming groups of samples of the audio signal from time domain to frequency domain, to form frames of transform coefficients. The method may further include grouping each frame of transform coefficients into a plurality of groups, wherein each group contains a plurality of sub-frames, and wherein each sub-frame contains a certain number of transform coefficients. The method may further include determining a norm for each of the sub-frames based on the sub-frame's rms. The method may further include quantizing the rms for each sub-frame. The method may further include normalizing the coefficients of each sub-frame by dividing each coefficient within the sub-frame by the quantized rms of the sub-frame. The method may further include using a first lattice vector quantizer to quantize coefficients at rates greater than 1 bit per coefficient. The method may further include using a second lattice vector quantizer to quantize coefficients at a rate of 1 bit per coefficient.

A computer-readable medium having embodied thereon a program is also provided, the program being executable by a machine to perform any of the methods described herein.

In accordance with various embodiments of the present disclosure, a 22 kHz encoder for encoding an audio signal is provided. The encoder may include a transform module operable to transform a frame of time domain samples of the audio signal to frequency domain, forming a frame of transform coefficients. The encoder may further include a first lattice vector quantizer module operable to quantize transform coefficients at rates greater than 1 bit per coefficient. The encoder may further include a second lattice vector quantizer module operable to quantize transform coefficients at a rate of 1 bit per coefficient. The method may further include a coder module operable to variable bit-length code indices of quantization for the coefficients quantized by the first lattice vector quantizer.

In accordance with various embodiments of the present disclosure, an endpoint is provided. The endpoint may include an audio input/output interface, a microphone communicably coupled to the audio input/output interface, a speaker communicably coupled to the audio input/output interface, and a 22 kHz audio encoder communicably coupled to the audio input/output interface. The endpoint may further include a bus communicably coupled to the audio input/output interface, a video input/output interface communicably coupled to the bus, a camera communicably coupled to the video input/output interface, and a display device communicably coupled to the video input/output interface.

BRIEF DESCRIPTION OF THE SEVERAL VIEWS OF THE DRAWINGS

A better understanding of the invention can be had when the following detailed description of the preferred embodiments is considered in conjunction with the following drawings, in which.

DETAILED DESCRIPTION OF THE INVENTION

Figure 1:
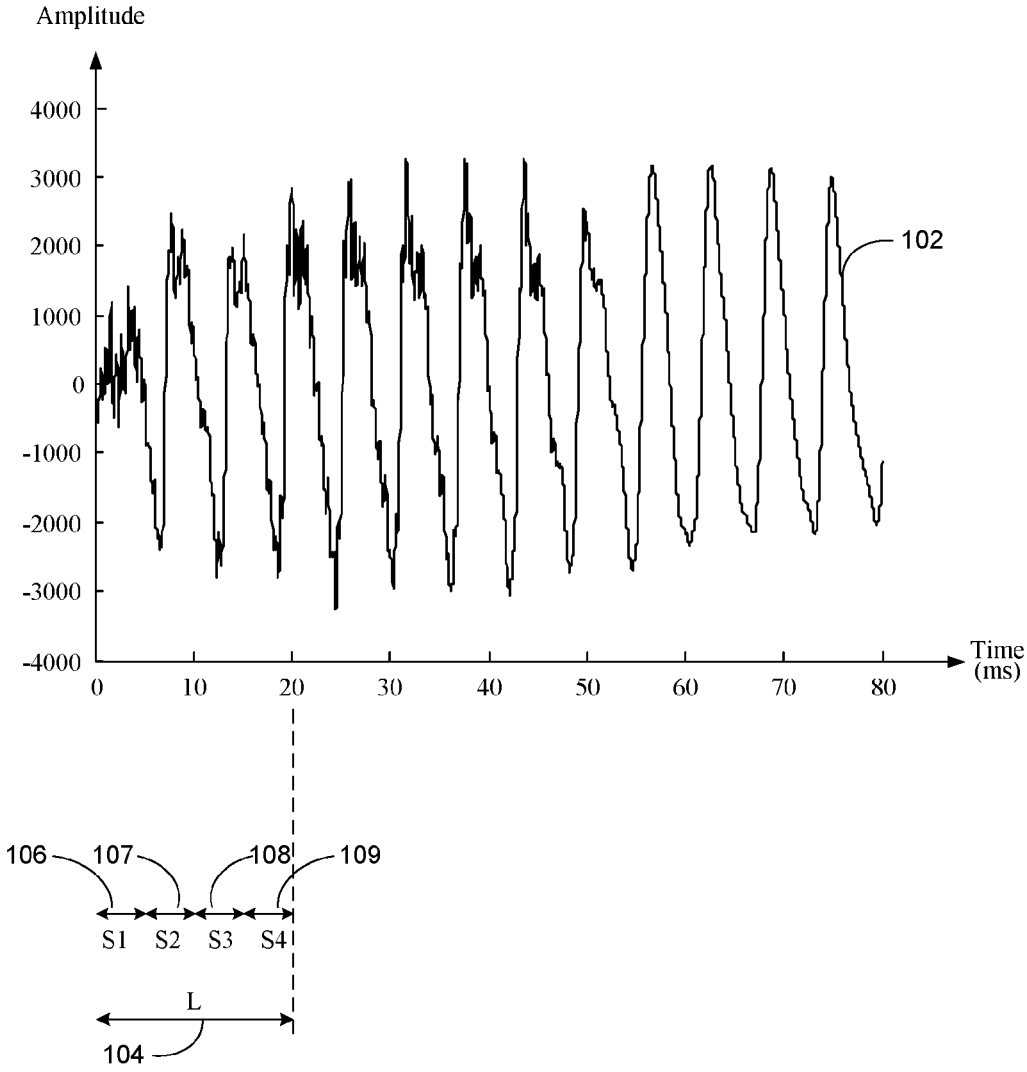
FIG. 1 depicts an exemplary dual transform scheme according to an embodiment of the present disclosure.

Various embodiments of the present disclosure expand and improve the performance of audio signal processing by using an innovative encoder and decoder. The encoding process broadly includes a transform process, a quantization process, and an encoding process. Various embodiments of the present disclosure provide improvements in all three processes.

In most prior art audio signal processing, the audio signal frame has a fixed length. The shorter the frame length, the shorter the delay. The shorter frame length also provides better time resolution and better performance for high frequencies. But a short frame provides poor frequency resolution. In contrast, the longer the frame length, the longer the delay. But a longer frame provides better frequency resolution and better performance at lower frequencies to resolve pitch harmonics. In a compromise, the frame length is typically in the range of 20 ms, which is the adopted frame length in the G.722.1 recommendation.

In accordance with various embodiments of the present disclosure, at least two different lengths of audio sample frames may be used. One has a longer frame length and is designed for better representation of the low frequency spectrum; another has a shorter frame length, is used for the high frequency signals, and provides better resolution at high frequency. The combination of two signal frames improves the sound quality. It can expand the spectrum response to the full human audio spectrum, e.g., approximately 20 Hz to approximately 22 kHz.

Rather than using predetermined bit allocation within a few categories, according to one embodiment of the present disclosure, the bit allocation may be adaptive and dynamic. Dynamic bit allocation may be employed during the quantization of transform coefficients. Thus the available bits are put to best uses.

With at least two transforms, the transform coefficients to be quantized and encoded are more than with a single transform. In one embodiment of the present disclosure, instead of using a simple scalar quantization method, a fast lattice vector quantization method may be used. Vector quantization is generally much more efficient than the simpler scalar quantization method. In particular, lattice vector quantization (LVQ) has advantages over conventional well-known LBG (Linde, Buzo, and Gray) vector quantization in that it is a relatively simple quantization process and can achieve savings of required memory because of the regular structure of an LVQ codebook. However, lattice vector quantization has not been widely used in real-time speech and audio-coding due to several limitations, including the difficulties of how to truncate a lattice for a given rate to create an LVQ codebook which matches the probability density function (PDF) of the input source, how to quickly translate the codevectors (lattice points) of the LVQ codebook to their indices, and how to quantize the source vectors which lie outside the truncated lattice ("outliers").

A fast LVQ (FLVQ) according to an embodiment of the present disclosure avoids the above mentioned limitations. The FLVQ includes a higher rate quantizer (HRQ) and a lower rate quantizer (LRQ). In quantizing the transform coefficients, the quantizer scales the coefficients instead of the lattice codebook in order to use a fast searching algorithm and then rescales the reconstructed coefficients at the decoder. This method of scaling coefficients can also solve the "outlier" problem by bringing the outliers (large coefficients) back within the truncated lattice which is used as the LVQ codebook. A PDF of the input sources, e.g., human voices or audible music is developed from a large collection of various audio sources. Once the limitations of LVQ are removed, the use of FLVQ in the embodiment of the present disclosure improves the quantization efficiency over the prior art scalar quantization.

In another embodiment of the present disclosure, the quantization and encoding efficiency may be further improved by dynamic Huffman coding. It is well known that Huffman coding, as one of the entropy coding methods, is most useful when the source is unevenly distributed. The transform coefficients are typically unevenly distributed; hence, using Huffman coding can improve the coding efficiency. In this embodiment of the present disclosure, the Huffman coding may be employed to encode both the amplitude envelopes and quantization indices of the transform coefficients when the Huffman coding reduces the bit requirement. In determining whether the Huffman coding is used or not, the total number of bits using Huffman coding and the number of available bits used for quantization of norms or transform coefficients are compared. The Huffman coding may be used only if there is some saving. This way, the best coding method is used.

Dual Transform

In one embodiment, two frame sizes are used, referred to as a long frame and a short frame. For simplicity, the present disclosure refers to dual transforms, although it should be understood that a single frame size may be used in some embodiments, or more than two frame sizes may be used.

Referring now to FIG. 1, an audio signal 102 is sampled and digitized. In this particular example, the audio signal is sampled at 48 kHz. Other sampling frequencies, however, may be used. In this example, a long frame L 104 has a frame length of approximately 20 ms. For each long frame L 104, there may be multiple short frames S1 106, S2 107, S3 108, and S4 109. In this example, each short frame 106, 107, 108, and 109 has a frame length of approximately 5 ms; thus, each long frame 104 has approximately 960 samples (48 kHz×0.02 s=960), while each short frame (106, 107, 108, 109) has approximately 240 samples (48 kHz×0.005 s=240). While there are four short frames 106, 107, 108, and 109 presented in this example, there can be a lesser or greater number of short frames; for example, the number of short frames may be 2, 3, 4, 5, etc.

These frames 104, 106, 107, 108, and 109 are transformed from the time domain to the frequency domain. For example, they may be transformed using the MLT (Modulated Lapped Transform) as described in ITU-T Recommendation G.722.1. For simplicity, the present disclosure refers to MLT transforms, although other types of transforms may be used, such as FFT (Fast Fourier Transform) and DCT (Discrete Cosine Transform), etc.

Figure 2A:
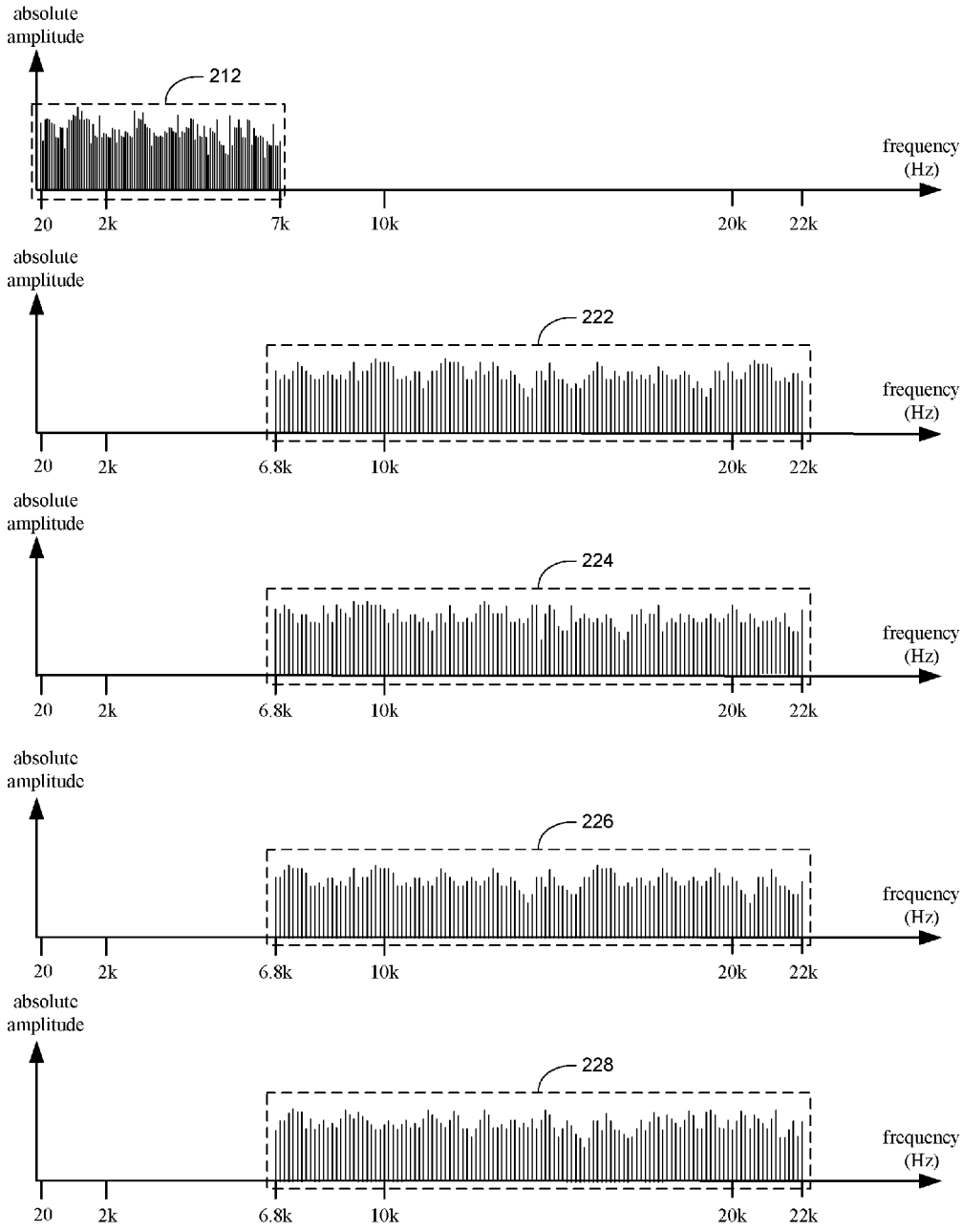
FIG. 2A depicts an exemplary coefficient grouping scheme according to an embodiment of the present disclosure.

The transform yields MLT coefficient sets 212, 222, 224, 226, and 228 as shown in FIG. 2A. Each short frame MLT coefficient set 222, 224, 226, and 228 has approximately 240 coefficients, and each coefficient is approximately 100 Hz apart from its neighbor. As to the long frame 212, there are approximately 960 MLT coefficients, or one coefficient every 25 Hz. These coefficients may be combined to form a single set of 1920 MLT coefficients. This set of coefficients can capture both the low frequency characters of the sound and the high frequency characters. Due to the coding bandwidth of 22 kHz, the MLT transform coefficients representing frequencies above approximately 22 kHz may be ignored.

The long transform is well-suited for capturing lower frequencies. The short transform is well-suited for capturing higher frequencies. So not all coefficients carry the same value for reproducing the transformed sound signal. In one embodiment, some of the coefficients may be ignored. Each short frame MLT coefficient set has approximately 240 coefficients. Each coefficient is approximately 100 Hz apart from its neighbor. In one embodiment, the coefficients less than approximately 6800 Hz and above approximately 22,000 Hz may be ignored. Therefore, 152 coefficients may be retained for each short frame, and the total number of coefficients for four short frames is 608. As to the long frame, since the long frame is used for representing lower frequency signals, coefficients for frequencies below approximately 7 kHz may be retained, and coefficients from the long transform above approximately 7 kHz may be discarded, in one embodiment. Thus, lower frequencies may have 280 coefficients. Thus, in one embodiment, the total coefficients may be 888 (608+280) for the audio spectrum up to approximately 22 kHz.

The coefficients may be grouped together into sub-frames and groups before quantization and coding. A "sub-frame" in this embodiment may be similar to the "region" in the G.722.1 method. A sub-frame is used as a unit to compute the amplitude envelope, assign variable bit allocation, and conduct further quantization and encoding. A group comprises many sub-frames having the same length within a range of the spectrum. The sub-frames within a group may have similar properties, and may be quantized or encoded in a similar way. But for sub-frames in different groups, the methods of quantizing or encoding can be different. Unlike the regions in the prior art method, the sub-frames can have different sizes, as can the groups, such that the different sub-frames and groups can represent the spectrum more closely and the bit requirements during the quantization and encoding can be reduced.

In the current example, the entire audio spectrum from 0 Hz to 22 kHz may be divided into four groups. The first group covers the frequencies from approximately 0 Hz to approximately 4 kHz. The first group has 10 sub-frames, and each sub-frame has 16 MLT coefficients. The total coefficients in the first group are 160 coefficients, all of which come from the long frame transform. The second group covers the spectrum from approximately 4 kHz to approximately 7 kHz. This second group has 5 sub-frames, each having 24 coefficients for a total of 120 coefficients. These coefficients come from the long frame transform. The third group covers the spectrum from approximately 7 kHz (or in some embodiments, approximately 6.8 kHz) to approximately 14 kHz. The long frame transform and the short frame transform may overlap at their boundaries to make the transition smoother. The third group has 9 sub-frames, each having 32 coefficients, for a total of 288 coefficients. These coefficients come from the four short frame transforms. The fourth group covers the spectrum from approximately 14 kHz to approximately 22 kHz. This group has 10 sub-frames, each having 32 coefficients for a total of 320 coefficients. Overall, there are 888 coefficients to be quantized and encoded in this example.

An Overlap Add (OLA) may be performed between the long-MLT and short-MLT coefficients using a triangular window on the frequency region of 250 Hz around the boundary frequency. For the long MLT the 10 coefficients starting at 6775 Hz are multiplied by a down-sloping ramp. For the short MLT the 2 coefficients starting at 6800 Hz are multiplied by an up-sloping ramp.

In grouping the coefficients into sub-frames and groups according to the above scheme, those coefficients may be arranged according to the frequencies, from low frequencies to high frequencies. For example, coefficients for the same frequency may be grouped together: a coefficient from L is followed by the one from S1, S2, S3, and S4, then the next higher frequency from L again and repeat. Other arrangements or sequences are possible and acceptable. For example, coefficients from the same transform may be grouped together, i.e., all coefficients from L transform may be first, followed by coefficients from the S1 transform, S2, S3, and S4 transforms.

It is found that the arrangement or sequence here may affect the quantization or encoding later on. In one embodiment, the following arrangement appears to generally provide a good result for the quantization and encoding scheme described later on. The coefficients from the long frame transform are arranged according to the frequency from low to high into the first group and second group. The coefficients from the four short transforms are not arranged generally according to their frequency, but not strictly according to the frequency sequence. First, 8 coefficients from the first short frame transform are selected and arranged according to the frequency sequence. Then the 8 coefficients of the same frequency from the second short frame transform are selected. Similarly, the 8 coefficients of the same frequency from the third short frame transform are selected. Then those from the fourth short frame transform are selected. After that, we go back to the first short frame transform S1 to select the next 8 coefficients and repeat the process until all coefficients from the short frame transforms are selected.

Using the above dual-transform and grouping, there are 4 groups and 34 sub-frames, each sub-frame having 16, 24, or 32 coefficients. Unlike the single transform in a prior art method that can only transform either the low frequency or the high frequency, or neither with fair resolution, various embodiments of the present disclosure can provide good resolution at both lower frequency and higher frequency of the audio spectrum. The computation load is only slightly more than a single short frame transform (e.g., 5 ms frame length, 48 kHz sampling rate) to expand the spectrum range to full audio spectrum at 22 kHz. These coefficients represent the full audio spectrum. These coefficients may be quantized and encoded using a variety of quantization or encoding methods, for example using the method described in G.722.1. If the G.722.1 method is used, the amplitude envelope of each sub-frame is first calculated, scalar quantized, and Huffman coded. The amplitude envelopes are also used to allocate bits for encoding the coefficient indices within each sub-frame according to the categories that the sub-frame is assigned. Then the coefficient indices are quantized according to their categories.

Figure 2B:
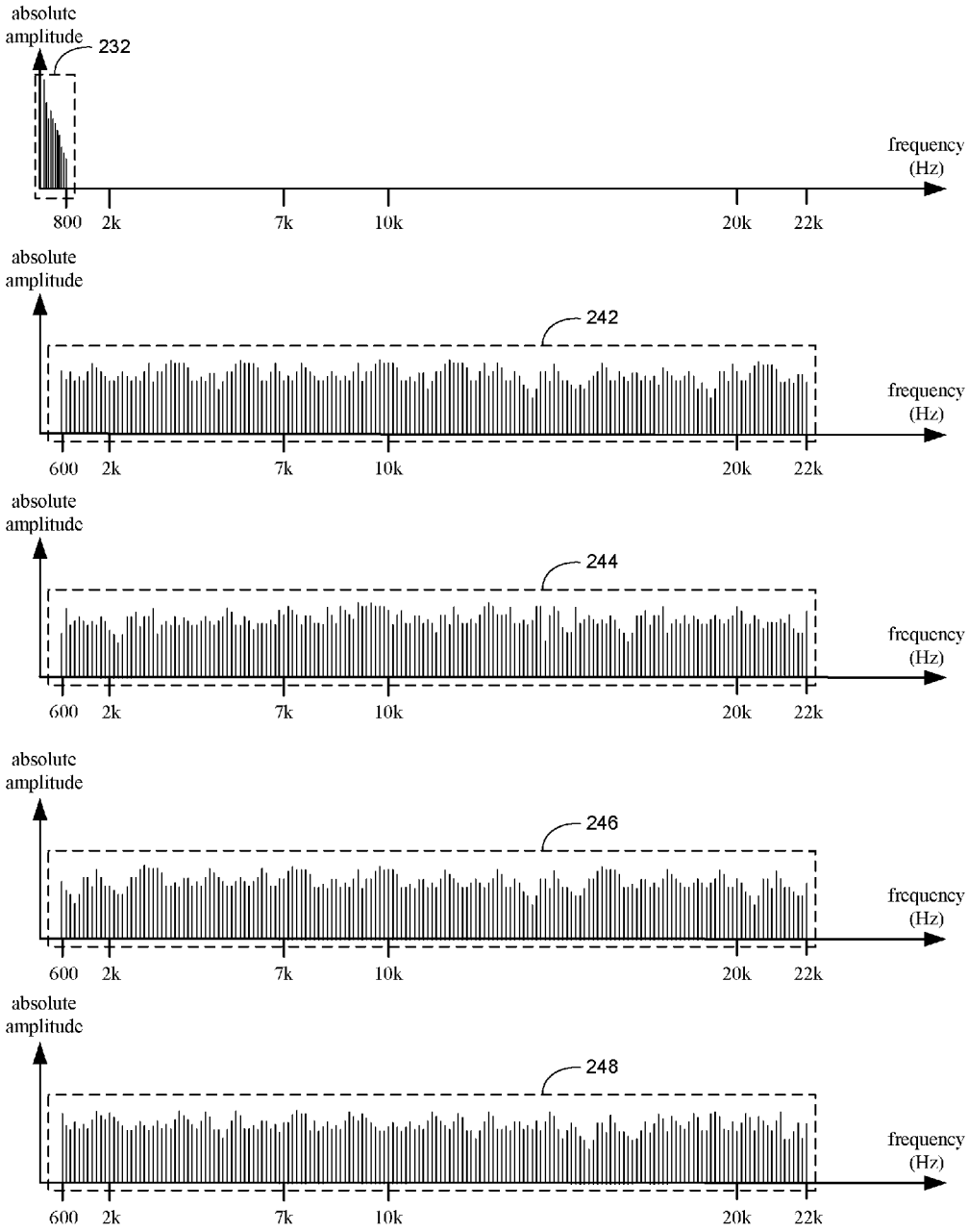
FIG. 2B depicts an exemplary coefficient grouping scheme according to another embodiment of the present disclosure.

The above-described scheme is useful for speech and general music. In accordance with another embodiment, a percussion-type signal may be present in the audio signal. A percussion-type signal may be detected based on such features as an average gradient ramp of long MLT coefficients over the frequency region of up to approximately 10 kHz; location of the maximum long MLT coefficient; and zero-crossing rate (ZCR) of long MLT coefficients. Examples of a percussion-type signal include without limitation sounds produced by castanets and triangles, etc. If such a percussion-type signal is detected, the boundary frequency for the longer frame transform coefficients may be adjusted to approximately 800 Hz (rather than approximately 7 kHz), as depicted in FIG. 2B. This adjustment advantageously reduces pre-echo phenomena. Accordingly, in this embodiment, the long frame transform coefficients 232 may include frequencies in the range of approximately 0 Hz to approximately 800 Hz, and the short frame transform coefficients 242, 244, 246, and 248 may include frequencies in the range of approximately 600 Hz to approximately 22 kHz. The overlap of frequencies aids in providing a smooth transition.

An OLA may be performed between the long-MLT and short-MLT coefficients using a triangular window on the frequency region of 250 Hz around the boundary frequency. For the long MLT the 10 coefficients starting at 575 Hz are multiplied by a down-sloping ramp. For the short MLT the 2 coefficients starting at 600 Hz are multiplied by an up-sloping ramp.

The lower 400 long-MLT coefficients centered at 25 Hz intervals are divided into 20 groups, each having 20 coefficients. The spectrum energy, $E_i$, in each group is computed as follows:

$$E_i = \begin{cases} \sum_{k=0}^{19} x_k^2, & E_i \geq THRQ \\ THRQ, & E_i < THRQ \end{cases}, \quad 0 \leq i \leq 19 \qquad \text{Eq. 1}$$

where x is the long-MLT coefficients, i is the group number, and THREQ is the threshold in quiet which may be experimentally chosen as THREQ=7000.

The natural logarithm of the group energy ratio between the current frame and the previous frame, $R_{Ei}$, is computed as follows:

$$R_{E_i} = \ln\left(\frac{E_{i,n}}{E_{i,n-1}}\right), 0 \le i \le 19 \quad \text{Eq. 2}$$

where n is the frame number.

The average gradient ramp of the rising edge, $Ramp_{up}$, is computed as follows:

$$Ramp_{up} = \frac{\sum_{i=0}^{19} (\max(R_{E_i}, 0) * E_i)}{\sum_{i=0}^{19} E_i}. \quad \text{Eq. 3}$$

The average gradient ramp of the falling edge, $Ramp_{down}$, is computed as follows:

$$Ramp_{down} = \frac{\sum_{i=0}^{19} (-\min(R_{E_i}, 0) * E_i)}{\sum_{i=0}^{19} E_i}. \quad \text{Eq. 4}$$

A percussion-type signal is detected if the following conditions are met: (1) $Ramp_{up}$>THRERAMP, where THRERAMP is the predefined threshold of ramp and equals 1.5; (2) The first long-MLT coefficient, $x_0$, is the maximum of long-MLT coefficients; and (3) The zero-crossing rate, ZCR, is less than the predefined threshold, THREZCR=0.1.

If a percussion-type signal is detected, the boundary frequency is adjusted to approximately 800 Hz for the current frame and the next 2 frames. If a condition $Ramp_{down}$>1 is true in the next frames n+1 or n+2, the encoder will work with the adjusted boundary frequency for 8 frames. Otherwise, the encoder will turn back to a boundary frequency of 7 kHz in the frame n+3.

In the percussion-type signal mode when the boundary frequency is approximately 800 Hz, the dual-MLT coefficients are divided into 38 sub-frames with different lengths. There are 32 long-MLT coefficients representing frequencies below 800 Hz which are split into two sub-frames of 16 coefficients. The short-MLT coefficients are divided into various groups: the first group having 12 sub-frames of 16 coefficients and representing frequencies of 600 Hz to 5.4 kHz, the second group having 12 sub-frames of 24 coefficients and representing frequencies of 5.4 kHz to 12.6 kHz, and the third group having 12 sub-frames of 32 coefficients and representing frequencies of 12.6 kHz to 22.2 kHz. Each sub-frame comprises the coefficients of the same short-MLT.

Amplitude Envelopes

The amplitude envelopes of sub-frames are quantized and analyzed to determine whether Huffman coding should be used. A fixed bit allocation may be assigned to each amplitude envelope as a default and a benchmark. If using Huffman coding can save some bits comparing to the fixed bits, then it may be used. A Huffman flag for amplitude envelope is set, so the decoder knows whether to apply Huffman coding. The number of bits saved is stored in the bits available for the remaining encoding. Otherwise, Huffman coding is not used, the flag is cleared and the default fixed bit is used.

For example, in one embodiment, each envelope is allocated 5 bits. The total default bits used for envelopes are 34×5=170 bits. Assuming the transmission rate is 64 kbit/s, then the amount of bits for each frame is 64 kbit/s×20 ms=1280 bits. Six flag bits are reserved in this example. Thus, the available bits for encoding coefficients indices are 1280−6−170=1104 bits.

For each sub-frame, the amplitude envelope, also called norm, is defined as the RMS (Root-Mean-Square) value of the MLT coefficients in the sub-frame, and is computed as follows:

$$\text{rms}(r) = \sqrt{\frac{1}{M(r)} \sum_{n=0}^{M(r)} mlt(r, n) mlt(r, n)}, \quad \text{Eq. 5}$$

where r is the index of the sub-frame, M(r) is the size of the sub-frame, which can be 16, 24 or 32, and mlt(r,n) is the nth MLT coefficient of the rth sub-frame. In the current example, when 1≦r≦10, M(r) is 16, all these sub-frames are in the first group, 0-4 kHz;

when 11≦r≦15, M(r) is 24, all these sub-frames are in the second group, 4 kHz-7 kHz;

when 16≦r≦24, M(r) is 32, all these sub-frames are in the third group, 6.8 kHz-14 kHz;

when 25≦r≦34, M(r) is 32, all these sub-frames are in the fourth group, 14 kHz-22 kHz;

The rms(r) values are calculated and scalar quantized with a logarithmic quantizer. Table 1 below shows the codebook of the logarithmic quantizer.

TABLE 1

40-level Codebook for Norm Quantization

| index | Code |
|---|---|
| 0 | $2^{17.0}$ |
| 1 | $2^{16.5}$ |
| 2 | $2^{16.0}$ |
| 3 | $2^{15.5}$ |
| 4 | $2^{15.0}$ |
| 5 | $2^{14.5}$ |
| 6 | $2^{14.0}$ |
| 7 | $2^{13.5}$ |
| 8 | $2^{13.0}$ |
| 9 | $2^{12.5}$ |
| 10 | $2^{12.0}$ |
| 11 | $2^{11.5}$ |
| 12 | $2^{11.0}$ |
| 13 | $2^{10.5}$ |
| 14 | $2^{10.0}$ |
| 15 | $2^{9.5}$ |
| 16 | $2^{9.0}$ |
| 17 | $2^{8.5}$ |
| 18 | $2^{8.0}$ |
| 19 | $2^{7.5}$ |
| 20 | $2^{7.0}$ |
| 21 | $2^{6.5}$ |
| 22 | $2^{6.0}$ |
| 23 | $2^{5.5}$ |
| 24 | $2^{5.0}$ |
| 25 | $2^{4.5}$ |
| 26 | $2^{4.0}$ |
| 27 | $2^{3.5}$ |
| 28 | $2^{3.0}$ |
| 29 | $2^{2.5}$ |
| 30 | $2^{2.0}$ |
| 31 | $2^{1.5}$ |
| 32 | $2^{1.0}$ |
| 33 | $2^{0.5}$ |
| 34 | $2^{0.0}$ |
| 35 | $2^{-0.5}$ |

TABLE 1-continued

| 40-level Codebook for Norm Quantization | |
|---|---|
| index | Code |
| 36 | $2^{-1.0}$ |
| 37 | $2^{-1.5}$ |
| 38 | $2^{-2.0}$ |
| 39 | $2^{-2.5}$ |

The amplitude envelope of the first sub-frame, rms(1), is quantized with 5 bits and its quantization index is directly transmitted to the decoder. Thus, only the first 32 codewords are used to quantize rms(1). The remaining 33 amplitude envelopes are quantized with all 40 codewords and the obtained indices are differentially coded as follows.

$$\text{differential index}=\text{index}(i+1)-\text{index}(i) \quad \text{Eq. 6}$$

where i=0, 1, 2, . . . . The differential indices are constrained into the range of [−15, 16]. The negative differential indices are first adjusted and then the positive differential indices are adjusted. Finally, Huffman coding is applied to the adjusted differential indices. The total bits used for Huffman coding are then compared with the number of bits used for the straight coding (i.e., without Huffman coding). The Huffman code may be transmitted on the channel if the total bits are less than without Huffman coding. Otherwise, the differential code of the quantization indices will be transmitted to the decoder. Therefore, the bits encoded may always be the least. If the Huffman code is used, then the Huffman flag is set, and the saved bit is returned to the available bits. For example, if the total bits for Huffman coding are 160 bits, then 170−160=10 bits are saved. The available bits become 10+1104=1114 bits.

Adaptive Bit-allocation Scheme

An adaptive bit-allocation scheme based on the energies of the groups of transform coefficients may be used to allocate the available bits in a frame among the sub-frames. In one embodiment, an improved bit-allocation scheme may be used. Unlike the scheme used in G.722.1, the adaptive bit allocation for coefficient indices is not fixed by categories, but by the allocation process at the same time as the amplitude envelopes are quantized. The bit allocation may be as follows:

Let Remainder denote the total number of available bits and r(n) denote the number of bits allocated to the nth sub-frame. In the above example, Remainder=1114 with Huffman coding applied to amplitude envelopes:

Step 0. Initialize the bit allocation to zero, i.e.,: r(n)=0, where n=1, 2, 3, . . . N, where N is the total number of sub-frames. In the above example, N is 34.

Step 1. Find the index n of the sub-frame which has the maximum RMS among sub-frames.

Step 2. Allocate M(n) bit to the nth sub-frame, i.e., r(n)=r(n)+M(n). (Here M(n) is the number of coefficients in the nth sub-frame).

Step 3. Divide rms(n) by 2 and Remainder=Remainder−M(n).

Step 4. If Remainder≧16, repeat Steps 1 to 3. Otherwise stop.

After this bit allocation, all bits are allocated to sub-frames, except a small remainder bits. Some sub-frames may not have any bits allocated to them because the RMS values of those sub-frames are too small, i.e., there is no appreciable contribution from that part of the spectrum to the audio signal. That part of the spectrum may be ignored.

Fast Lattice Vector Quantization

Although prior art quantization and encoding methods may be used to implement the embodiments described above to expand the processed audio signal to full audio spectrum, they may be not bring the full potential to a wide audience. Using prior art methods, the bit rate requirement can be high, which makes it more difficult to transmit the processed full spectrum audio signals. A new Fast Lattice Vector Quantization (FLVQ) scheme according to one embodiment of the present disclosure can be used, which improves coding efficiency and reduces the bit requirement. The FLVQ may be used for quantization and encoding of any audio signals.

The MLT coefficients are divided into sub-frames of 16, 24, and 32 coefficients, respectively. The RMS, or norm, of each sub-frame, i.e., the root-mean-square value of the coefficients in the sub-frame, is calculated and the coefficients are normalized by the quantized norm. The normalized coefficients in each sub-frame are quantized in 8-dimensional vectors by the Fast LVQ. The Fast Lattice Vector Quantizer comprises a higher rate quantizer (HRQ) and a lower rate quantizer (LRQ). The higher rate quantizer is designed to quantize the coefficients at the rates greater than 1 bit/coefficient, and the lower rate quantizer is used for the quantization with 1 bit/coefficient.

Lattice vector quantizers are optimal only for uniformly distributed sources. Geometrically, a lattice is a regular arrangement of points in N-dimensional Euclidean space. In this case, the source (i.e., the MLT coefficients) is non-uniform and therefore an entropy coding—Huffman Coding—is applied to the indices of the higher rate quantization to improve the performance of HRQ.

Higher Rate Quantization

The higher rate quantizer may be based on the Voronoi code for the lattice $D_8$ and designed to quantize the normalized MLT coefficients at the rates of 2 to 6 bits/coefficient. The codebook of this sub-quantizer may be constructed from a finite region of the lattice $D_8$ and is not stored in memory. The codevectors can be generated by a simple algebraic method.

The lattice $D_8$ is defined as follows:

$$D_8 = \left\{(y_1, y_2, y_3, y_4, y_5, y_6, y_7, y_8) \in Z_8 \middle| \sum_{i=1}^{8} y_i = even\right\}, \quad \text{Eq. 7}$$

where $Z_8$ is the lattice which consists of all points with integer coordinates. It can be seen that $D_8$ is an integer lattice and consists of the points $y=(y_1, y_2, y_3, y_4, y_5, y_6, y_7, y_8)$ having integer coordinates with an even sum. For example, a vector y=(−1, −1, 0, 2, 1, −3, 2, 4) has an even sum of 4 and therefore y is a lattice point of $D_8$.

Conway and Sloane have developed fast quantization algorithms for some well-known lattices, which could be applied to $D_8$. However, their algorithms assume an infinite lattice which can not be used as the codebook in the real-time audio coding. In other words, for a given rate their algorithms can not be used to quantize the input vectors lying outside the truncated lattice region.

In one embodiment, the normalized MLT coefficients are quantized with the rates of 2, 3, 4, and 5 bits/coefficient, respectively. In another embodiment such as when a percussion-type signal is detected, the maximum quantization rate may be 6 bits/coefficient. To minimize the distortion for a given rate, the lattice $D_8$ may be truncated and scaled. Actually, the coefficients are scaled instead of the lattice codebook in order to use the fast searching algorithm described by Conway et al., and then rescale the reconstructed coefficients at the decoder. In addition, a fast method for quantizing "outliers" may be developed.

For a given rate R bits/dimension (1<R<7), each 8-dimensional coefficient vector $x=(x_1, x_2, x_3, x_4, x_5, x_6, x_7, x_8)$ may be quantized as follows:

1) Apply a small offset $a=2^{-6}$ to each component of the vector x to avoid any lattice point on the boundary of the truncated Voronoi region, i.e.,: $x_1=x-a$, where $a=(2^{-6}, 2^{-6}, 2^{-6}, 2^{-6}, 2^{-6}, 2^{-6}, 2^{-6}, 2^{-6})$.

2) Scale the vector $x_1$ by the scaling factor $\alpha$: $x_2=\alpha x_1$. For a given rate R, the optimal scaling factor is selected experimentally and shown in Table 2 below.

TABLE 2

Scaling factors used for the higher rate quantizer

| R | α |
|---|---|
| 2 | 2/3 |
| 3 | 4/3 |
| 4 | 8/3 |
| 5 | 16/3 |
| 6 | 32/3 |

3) Find the nearest lattice point v of $D_8$ to the scaled vector $x_2$. This can be done by using the searching algorithm described in Conway and Sloane.

4) Suppose v is a codevector in the Voronoi region truncated with the given rate R and compute the index vector $k=(k_1, k_2, k_3, k_4, k_5, k_6, k_7, k_8)$ of v, where $0 \leqq k_i < 2^R$ an i=1, 2, . . . , 8. The index k is given by $$k=(vG^{-1}) \text{ modulo } r \text{ with } r=2^R, \quad \text{Eq. 8}$$

where G is the generator matrix for $D_8$ and defined as follows:

$$G=\begin{bmatrix} 2 & 0 & 0 & 0 & 0 & 0 & 0 & 0 \\ 1 & 1 & 0 & 0 & 0 & 0 & 0 & 0 \\ 1 & 0 & 1 & 0 & 0 & 0 & 0 & 0 \\ 1 & 0 & 0 & 1 & 0 & 0 & 0 & 0 \\ 1 & 0 & 0 & 0 & 1 & 0 & 0 & 0 \\ 1 & 0 & 0 & 0 & 0 & 1 & 0 & 0 \\ 1 & 0 & 0 & 0 & 0 & 0 & 1 & 0 \\ 1 & 0 & 0 & 0 & 0 & 0 & 0 & 1 \end{bmatrix} \quad \text{Eq. 9}$$

and $$G^{-1}=\begin{bmatrix} \frac{1}{2} & 0 & 0 & 0 & 0 & 0 & 0 & 0 \\ -\frac{1}{2} & 1 & 0 & 0 & 0 & 0 & 0 & 0 \\ -\frac{1}{2} & 0 & 1 & 0 & 0 & 0 & 0 & 0 \\ -\frac{1}{2} & 0 & 0 & 1 & 0 & 0 & 0 & 0 \\ -\frac{1}{2} & 0 & 0 & 0 & 1 & 0 & 0 & 0 \\ -\frac{1}{2} & 0 & 0 & 0 & 0 & 1 & 0 & 0 \\ -\frac{1}{2} & 0 & 0 & 0 & 0 & 0 & 1 & 0 \\ -\frac{1}{2} & 0 & 0 & 0 & 0 & 0 & 0 & 1 \end{bmatrix} \quad \text{Eq. 10}$$

5) Compute the codevector y from the index vector k using the algorithm described by Conway et al. and then compare y with v. If y and v are exactly same, k is the index of the best codevector to $x_2$ and stop here. Otherwise, the input vector $x_2$ is an outlier and may be quantized by the following steps.

6) Scale down the vector $x_2$ by 2: $x_2=x_2/2$.

7) Find the nearest lattice point u of $D_8$ to $x_2$ and then compute the index vector j of u.

8) Find the codevector y from the index vector j and then compare y with u. If y is different from u, repeat Steps 6) to 8). Otherwise, compute $w=x_2/16$. Due to the normalization of MLT coefficients, a few iterations may be performed to find a codevector to the outlier in the truncated lattice.

9) Compute $x_2=x_2+w$.

10) Find the nearest lattice point u of $D_8$ to $x_2$ and then compute the index vector j of u.

11) Find the codevector y from the index vector j and then compare y with u. If y and u are exactly same, k=j and repeat Steps 9) to 11). Otherwise, k is the index of the best codevector to $x_2$ and stop.

The decoding procedure of the higher rate quantizer may be carried out as follows:

1) Find the codevector y from the index vector k according to the given rate R.

2) Rescale the codevector y by the scaling factor $\alpha$ given in Table 2 above: $y_1=y/\alpha$.

3) Add the same offset a used in Step 1) of the quantization process to the resealed codevector $y_1$:$y_2=y_1+a$, and then stop.

Lower Rate Quantization

A lower rate quantizer based on the so-called rotated Gosset lattice $RE_8$ may be provided to quantize the normalized MLT coefficients with the rate of 1 bit/coefficient.

The lattice $RE_8$ consists of the points falling on concentric spheres of radius $2\sqrt{2r}$ centered at the origin, where r=0, 1, 2, 3, . . . . The set of points on a sphere constitutes a spherical code and can be used as a quantization codebook.

In the lower rate quantizer, the codebook consists of all 240 points of $RE_8$ lying on the sphere of r=1 and 16 additional points which do not belong to the lattice $RE_8$. The additional points are obtained by permutations of components of two vectors: (−2, 0, 0, 0, 0, 0, 0, 0) and (2, 0, 0, 0, 0, 0, 0, 0) and used to quantize the input vectors close to the origin. To develop the fast indexing algorithm, the codevectors of the codebook are arranged in a particular order and shown in Table 3 below.

For each 8-dimensional coefficient vector $x=(x_1, x_2, x_3, x_4, x_5, x_6, x_7, x_8)$, quantization may be performed as follows:

1) Apply an offset $a=2^{-6}$ to each component of the vector x: $x_1=x-a$, where $a=(2^{-6}, 2^{-6}, 2^{-6}, 2^{-6}, 2^{-6}, 2^{-6}, 2^{-6}, 2^{-6})$.

2) Scale the vector $x_1$ by the scaling factor $\alpha$: $x_2=\alpha x_1$. The optimal scaling factor is experimentally chosen as $\alpha=1.25$.

3) Obtain the new vector $x_3$ by reordering the components of $x_2$ in descending order.

4) Find in Table 4 the best-matched vector l to $x_3$ in terms of the mean-squared error (MSE). The vectors given in Table 4 below are called as the leaders of the codevectors and any codevector in the codebook can be generated by permutation of its leader.

5) Obtain the best codevector y by reordering the components of l in the original order.

6) Find the flag vector of l in Table 5 below and then obtain the vector z by reordering the components of the flag vector in the original order. The flag vectors are defined as follows: if the leader consists of −2, 2, and 0, −2 and 2 are indicated by 1 and 0 is indicated by 0; if the leader consists of −1 and 1, −1 is indicated by 1 and 1 is indicated by 0.

7) Find the index offset K related to the leader l in Table 6 below.

8) If the leader l is (2, 0, 0, 0, 0, 0, 0, −2) and the codevector y has the component 2 with index lower than that of the component −2, the offset K is adjusted as: K=K+28.

9) Compute the vector dot product $i=zp^T$, where p=(1, 2, 4, 8, 16, 32, 64, 128).

10) Find the index increment j related to the codevector y in Table 7 from i.

11) Compute the index k of the codevector y: k=K+j, and then stop.

The following steps may be taken in the decoding procedure of the lower rate quantizer:

1) Find the codevector y in Table 3 from the received index k.

2) Rescale the codevector y by the scaling factor $\alpha=1.5$: $y_1=y/\alpha$.

3) Add the same offset a used in Step 1) of the encoding procedure to the rescaled codevector $y_1$:$y_2=y_1+a$, and then stop.

TABLE 3

Codebook of the lower rate quantizer (LRQ)

| Index | Coderword | | | | | | | |
|---|---|---|---|---|---|---|---|---|
| 0 | 0 | 0 | 0 | 0 | 0 | 0 | 0 | 1 |
| 1 | 0 | −2 | 0 | 0 | 0 | 0 | 0 | 0 |
| 2 | 0 | 0 | −2 | 0 | 0 | 0 | 0 | 0 |
| 3 | 0 | 0 | 0 | −2 | 0 | 0 | 0 | 0 |
| 4 | 0 | 0 | 0 | 0 | −2 | 0 | 0 | 0 |
| 5 | 0 | 0 | 0 | 0 | 0 | −2 | 0 | 0 |
| 6 | 0 | 0 | 0 | 0 | 0 | 0 | −2 | 0 |
| 7 | 0 | 0 | 0 | 0 | 0 | 0 | 0 | −2 |
| 8 | 2 | 0 | 0 | 0 | 0 | 0 | 0 | 0 |
| 9 | 0 | 2 | 0 | 0 | 0 | 0 | 0 | 0 |
| 10 | 0 | 0 | 2 | 0 | 0 | 0 | 0 | 0 |
| 11 | 0 | 0 | 0 | 2 | 0 | 0 | 0 | 0 |
| 12 | 0 | 0 | 0 | 0 | 2 | 0 | 0 | 0 |
| 13 | 0 | 0 | 0 | 0 | 0 | 2 | 0 | 0 |
| 14 | 0 | 0 | 0 | 0 | 0 | 0 | 2 | 0 |
| 15 | 0 | 0 | 0 | 0 | 0 | 0 | 0 | 2 |
| 16 | −2 | −2 | 0 | 0 | 0 | 0 | 0 | 0 |
| 17 | −2 | 0 | −2 | 0 | 0 | 0 | 0 | 0 |
| 18 | −2 | 0 | 0 | −2 | 0 | 0 | 0 | 0 |
| 19 | −2 | 0 | 0 | 0 | −2 | 0 | 0 | 0 |
| 20 | −2 | 0 | 0 | 0 | 0 | −2 | 0 | 0 |
| 21 | −2 | 0 | 0 | 0 | 0 | 0 | −2 | 0 |
| 22 | −2 | 0 | 0 | 0 | 0 | 0 | 0 | −2 |
| 23 | 0 | −2 | −2 | 0 | 0 | 0 | 0 | 0 |
| 24 | 0 | −2 | 0 | −2 | 0 | 0 | 0 | 0 |
| 25 | 0 | −2 | 0 | 0 | −2 | 0 | 0 | 0 |
| 26 | 0 | −2 | 0 | 0 | 0 | −2 | 0 | 0 |
| 27 | 0 | −2 | 0 | 0 | 0 | 0 | −2 | 0 |
| 28 | 0 | −2 | 0 | 0 | 0 | 0 | 0 | −2 |
| 29 | 0 | 0 | −2 | −2 | 0 | 0 | 0 | 0 |
| 30 | 0 | 0 | −2 | 0 | −2 | 0 | 0 | 0 |
| 31 | 0 | 0 | −2 | 0 | 0 | −2 | 0 | 0 |
| 32 | 0 | 0 | −2 | 0 | 0 | 0 | −2 | 0 |
| 33 | 0 | 0 | −2 | 0 | 0 | 0 | 0 | −2 |
| 34 | 0 | 0 | 0 | −2 | −2 | 0 | 0 | 0 |
| 35 | 0 | 0 | 0 | −2 | 0 | −2 | 0 | 0 |
| 36 | 0 | 0 | 0 | −2 | 0 | 0 | −2 | 0 |
| 37 | 0 | 0 | 0 | −2 | 0 | 0 | 0 | −2 |
| 38 | 0 | 0 | 0 | 0 | −2 | −2 | 0 | 0 |
| 39 | 0 | 0 | 0 | 0 | −2 | 0 | −2 | 0 |
| 40 | 0 | 0 | 0 | 0 | −2 | 0 | 0 | −2 |
| 41 | 0 | 0 | 0 | 0 | 0 | −2 | −2 | 0 |
| 42 | 0 | 0 | 0 | 0 | 0 | −2 | 0 | −2 |
| 43 | 0 | 0 | 0 | 0 | 0 | 0 | −2 | −2 |
| 44 | −2 | 2 | 0 | 0 | 0 | 0 | 0 | 0 |
| 45 | −2 | 0 | 2 | 0 | 0 | 0 | 0 | 0 |
| 46 | −2 | 0 | 0 | 2 | 0 | 0 | 0 | 0 |
| 47 | −2 | 0 | 0 | 0 | 2 | 0 | 0 | 0 |
| 48 | −2 | 0 | 0 | 0 | 0 | 2 | 0 | 0 |
| 49 | −2 | 0 | 0 | 0 | 0 | 0 | 2 | 0 |

TABLE 3-continued

Codebook of the lower rate quantizer (LRQ)

| Index | Coderword | | | | | | | |
|---|---|---|---|---|---|---|---|---|
| 50 | −2 | 0 | 0 | 0 | 0 | 0 | 0 | 2 |
| 51 | 0 | −2 | 2 | 0 | 0 | 0 | 0 | 0 |
| 52 | 0 | −2 | 0 | 2 | 0 | 0 | 0 | 0 |
| 53 | 0 | −2 | 0 | 0 | 2 | 0 | 0 | 0 |
| 54 | 0 | −2 | 0 | 0 | 0 | 2 | 0 | 0 |
| 55 | 0 | −2 | 0 | 0 | 0 | 0 | 2 | 0 |
| 56 | 0 | −2 | 0 | 0 | 0 | 0 | 0 | 2 |
| 57 | 0 | 0 | −2 | 2 | 0 | 0 | 0 | 0 |
| 58 | 0 | 0 | −2 | 0 | 2 | 0 | 0 | 0 |
| 59 | 0 | 0 | −2 | 0 | 0 | 2 | 0 | 0 |
| 60 | 0 | 0 | −2 | 0 | 0 | 0 | 2 | 0 |
| 61 | 0 | 0 | −2 | 0 | 0 | 0 | 0 | 2 |
| 62 | 0 | 0 | 0 | −2 | 2 | 0 | 0 | 0 |
| 63 | 0 | 0 | 0 | −2 | 0 | 2 | 0 | 0 |
| 64 | 0 | 0 | 0 | −2 | 0 | 0 | 2 | 0 |
| 65 | 0 | 0 | 0 | −2 | 0 | 0 | 0 | 2 |
| 66 | 0 | 0 | 0 | 0 | −2 | 2 | 0 | 0 |
| 67 | 0 | 0 | 0 | 0 | −2 | 0 | 2 | 0 |
| 68 | 0 | 0 | 0 | 0 | −2 | 0 | 0 | 2 |
| 69 | 0 | 0 | 0 | 0 | 0 | −2 | 2 | 0 |
| 70 | 0 | 0 | 0 | 0 | 0 | −2 | 0 | 2 |
| 71 | 0 | 0 | 0 | 0 | 0 | 0 | −2 | 2 |
| 72 | 2 | −2 | 0 | 0 | 0 | 0 | 0 | 0 |
| 73 | 2 | 0 | −2 | 0 | 0 | 0 | 0 | 0 |
| 74 | 2 | 0 | 0 | −2 | 0 | 0 | 0 | 0 |
| 75 | 2 | 0 | 0 | 0 | −2 | 0 | 0 | 0 |
| 76 | 2 | 0 | 0 | 0 | 0 | −2 | 0 | 0 |
| 77 | 2 | 0 | 0 | 0 | 0 | 0 | −2 | 0 |
| 78 | 2 | 0 | 0 | 0 | 0 | 0 | 0 | −2 |
| 79 | 0 | 2 | −2 | 0 | 0 | 0 | 0 | 0 |
| 80 | 0 | 2 | 0 | −2 | 0 | 0 | 0 | 0 |
| 81 | 0 | 2 | 0 | 0 | −2 | 0 | 0 | 0 |
| 82 | 0 | 2 | 0 | 0 | 0 | −2 | 0 | 0 |
| 83 | 0 | 2 | 0 | 0 | 0 | 0 | −2 | 0 |
| 84 | 0 | 2 | 0 | 0 | 0 | 0 | 0 | −2 |
| 85 | 0 | 0 | 2 | −2 | 0 | 0 | 0 | 0 |
| 86 | 0 | 0 | 2 | 0 | −2 | 0 | 0 | 0 |
| 87 | 0 | 0 | 2 | 0 | 0 | −2 | 0 | 0 |
| 88 | 0 | 0 | 2 | 0 | 0 | 0 | −2 | 0 |
| 89 | 0 | 0 | 2 | 0 | 0 | 0 | 0 | −2 |
| 90 | 0 | 0 | 0 | 2 | −2 | 0 | 0 | 0 |
| 91 | 0 | 0 | 0 | 2 | 0 | −2 | 0 | 0 |
| 92 | 0 | 0 | 0 | 2 | 0 | 0 | −2 | 0 |
| 93 | 0 | 0 | 0 | 2 | 0 | 0 | 0 | −2 |
| 94 | 0 | 0 | 0 | 0 | 2 | −2 | 0 | 0 |
| 95 | 0 | 0 | 0 | 0 | 2 | 0 | −2 | 0 |
| 96 | 0 | 0 | 0 | 0 | 2 | 0 | 0 | −2 |
| 97 | 0 | 0 | 0 | 0 | 0 | 2 | −2 | 0 |
| 98 | 0 | 0 | 0 | 0 | 0 | 2 | 0 | −2 |
| 99 | 0 | 0 | 0 | 0 | 0 | 0 | 2 | −2 |
| 100 | 2 | 2 | 0 | 0 | 0 | 0 | 0 | 0 |
| 101 | 2 | 0 | 2 | 0 | 0 | 0 | 0 | 0 |
| 102 | 2 | 0 | 0 | 2 | 0 | 0 | 0 | 0 |
| 103 | 2 | 0 | 0 | 0 | 2 | 0 | 0 | 0 |
| 104 | 2 | 0 | 0 | 0 | 0 | 2 | 0 | 0 |
| 105 | 2 | 0 | 0 | 0 | 0 | 0 | 2 | 0 |
| 106 | 2 | 0 | 0 | 0 | 0 | 0 | 0 | 2 |
| 107 | 0 | 2 | 2 | 0 | 0 | 0 | 0 | 0 |
| 108 | 0 | 2 | 0 | 2 | 0 | 0 | 0 | 0 |
| 109 | 0 | 2 | 0 | 0 | 2 | 0 | 0 | 0 |
| 110 | 0 | 2 | 0 | 0 | 0 | 2 | 0 | 0 |
| 111 | 0 | 2 | 0 | 0 | 0 | 0 | 2 | 0 |
| 112 | 0 | 2 | 0 | 0 | 0 | 0 | 0 | 2 |
| 113 | 0 | 0 | 2 | 2 | 0 | 0 | 0 | 0 |
| 114 | 0 | 0 | 2 | 0 | 2 | 0 | 0 | 0 |
| 115 | 0 | 0 | 2 | 0 | 0 | 2 | 0 | 0 |
| 116 | 0 | 0 | 2 | 0 | 0 | 0 | 2 | 0 |
| 117 | 0 | 0 | 2 | 0 | 0 | 0 | 0 | 2 |
| 118 | 0 | 0 | 0 | 2 | 2 | 0 | 0 | 0 |
| 119 | 0 | 0 | 0 | 2 | 0 | 2 | 0 | 0 |
| 120 | 0 | 0 | 0 | 2 | 0 | 0 | 2 | 0 |
| 121 | 0 | 0 | 0 | 2 | 0 | 0 | 0 | 2 |
| 122 | 0 | 0 | 0 | 0 | 2 | 2 | 0 | 0 |
| 123 | 0 | 0 | 0 | 0 | 2 | 0 | 2 | 0 |
| 124 | 0 | 0 | 0 | 0 | 2 | 0 | 0 | 2 |
| 125 | 0 | 0 | 0 | 0 | 0 | 2 | 2 | 0 |

TABLE 3-continued

| Codebook of the lower rate quantizer (LRQ) | | | | | | | | |
|---|---|---|---|---|---|---|---|---|
| Index | Coderword | | | | | | | |
| 126 | 0 | 0 | 0 | 0 | 0 | 2 | 0 | 2 |
| 127 | 0 | 0 | 0 | 0 | 0 | 0 | 2 | 2 |
| 128 | −1 | −1 | 1 | 1 | 1 | 1 | 1 | 1 |
| 129 | −1 | 1 | −1 | 1 | 1 | 1 | 1 | 1 |
| 130 | −1 | 1 | 1 | −1 | 1 | 1 | 1 | 1 |
| 131 | −1 | 1 | 1 | 1 | −1 | 1 | 1 | 1 |
| 132 | −1 | 1 | 1 | 1 | 1 | −1 | 1 | 1 |
| 133 | −1 | 1 | 1 | 1 | 1 | 1 | −1 | 1 |
| 134 | −1 | 1 | 1 | 1 | 1 | 1 | 1 | −1 |
| 135 | 1 | −1 | −1 | 1 | 1 | 1 | 1 | 1 |
| 136 | 1 | −1 | 1 | −1 | 1 | 1 | 1 | 1 |
| 137 | 1 | −1 | 1 | 1 | −1 | 1 | 1 | 1 |
| 138 | 1 | −1 | 1 | 1 | 1 | −1 | 1 | 1 |
| 139 | 1 | −1 | 1 | 1 | 1 | 1 | −1 | 1 |
| 140 | 1 | −1 | 1 | 1 | 1 | 1 | 1 | −1 |
| 141 | 1 | 1 | −1 | −1 | 1 | 1 | 1 | 1 |
| 142 | 1 | 1 | −1 | 1 | −1 | 1 | 1 | 1 |
| 143 | 1 | 1 | −1 | 1 | 1 | −1 | 1 | 1 |
| 144 | 1 | 1 | −1 | 1 | 1 | 1 | −1 | 1 |
| 145 | 1 | 1 | −1 | 1 | 1 | 1 | 1 | −1 |
| 146 | 1 | 1 | 1 | −1 | −1 | 1 | 1 | 1 |
| 147 | 1 | 1 | 1 | −1 | 1 | −1 | 1 | 1 |
| 148 | 1 | 1 | 1 | −1 | 1 | 1 | −1 | 1 |
| 149 | 1 | 1 | 1 | −1 | 1 | 1 | 1 | −1 |
| 150 | 1 | 1 | 1 | 1 | −1 | −1 | 1 | 1 |
| 151 | 1 | 1 | 1 | 1 | −1 | 1 | −1 | 1 |
| 152 | 1 | 1 | 1 | 1 | −1 | 1 | 1 | −1 |
| 153 | 1 | 1 | 1 | 1 | 1 | −1 | −1 | 1 |
| 154 | 1 | 1 | 1 | 1 | 1 | −1 | 1 | −1 |
| 155 | 1 | 1 | 1 | 1 | 1 | 1 | −1 | −1 |
| 156 | −1 | −1 | −1 | −1 | 1 | 1 | 1 | 1 |
| 157 | −1 | −1 | −1 | 1 | −1 | 1 | 1 | 1 |
| 158 | −1 | −1 | −1 | 1 | 1 | −1 | 1 | 1 |
| 159 | −1 | −1 | −1 | 1 | 1 | 1 | −1 | 1 |
| 160 | −1 | −1 | −1 | 1 | 1 | 1 | 1 | −1 |
| 161 | −1 | −1 | 1 | −1 | −1 | 1 | 1 | 1 |
| 162 | −1 | −1 | 1 | −1 | 1 | −1 | 1 | 1 |
| 163 | −1 | −1 | 1 | −1 | 1 | 1 | −1 | 1 |
| 164 | −1 | −1 | 1 | −1 | 1 | 1 | 1 | −1 |
| 165 | −1 | −1 | 1 | 1 | −1 | −1 | 1 | 1 |
| 166 | −1 | −1 | 1 | 1 | −1 | 1 | −1 | 1 |
| 167 | −1 | −1 | 1 | 1 | −1 | 1 | 1 | −1 |
| 168 | −1 | −1 | 1 | 1 | 1 | 1 | −1 | −1 |
| 169 | −1 | −1 | 1 | 1 | 1 | −1 | 1 | −1 |
| 170 | −1 | −1 | 1 | 1 | 1 | −1 | −1 | 1 |
| 171 | −1 | 1 | −1 | −1 | −1 | 1 | 1 | 1 |
| 172 | −1 | 1 | −1 | −1 | 1 | −1 | 1 | 1 |
| 173 | −1 | 1 | −1 | −1 | 1 | 1 | −1 | 1 |
| 174 | −1 | 1 | −1 | −1 | 1 | 1 | 1 | −1 |
| 175 | −1 | 1 | −1 | 1 | −1 | −1 | 1 | 1 |
| 176 | −1 | 1 | −1 | 1 | −1 | 1 | −1 | 1 |
| 177 | −1 | 1 | −1 | 1 | −1 | 1 | 1 | −1 |
| 178 | −1 | 1 | −1 | 1 | 1 | 1 | −1 | −1 |
| 179 | −1 | 1 | −1 | 1 | 1 | −1 | 1 | −1 |
| 180 | −1 | 1 | −1 | 1 | 1 | −1 | −1 | 1 |
| 181 | −1 | 1 | 1 | 1 | 1 | −1 | −1 | −1 |
| 182 | −1 | 1 | 1 | 1 | −1 | 1 | −1 | −1 |
| 183 | −1 | 1 | 1 | 1 | −1 | −1 | 1 | −1 |
| 184 | −1 | 1 | 1 | 1 | −1 | −1 | −1 | 1 |
| 185 | −1 | 1 | 1 | −1 | −1 | −1 | 1 | 1 |
| 186 | −1 | 1 | 1 | −1 | −1 | 1 | −1 | 1 |
| 187 | −1 | 1 | 1 | −1 | −1 | 1 | 1 | −1 |
| 188 | −1 | 1 | 1 | −1 | 1 | 1 | −1 | −1 |
| 189 | −1 | 1 | 1 | −1 | 1 | −1 | 1 | −1 |
| 190 | −1 | 1 | 1 | −1 | 1 | −1 | −1 | 1 |
| 191 | 1 | 1 | 1 | 1 | −1 | −1 | −1 | −1 |
| 192 | 1 | 1 | 1 | −1 | 1 | −1 | −1 | −1 |
| 193 | 1 | 1 | 1 | −1 | −1 | 1 | −1 | −1 |
| 194 | 1 | 1 | 1 | −1 | −1 | −1 | 1 | −1 |
| 195 | 1 | 1 | 1 | −1 | −1 | −1 | −1 | 1 |
| 196 | 1 | 1 | −1 | 1 | 1 | −1 | −1 | −1 |
| 197 | 1 | 1 | −1 | 1 | −1 | 1 | −1 | −1 |
| 198 | 1 | 1 | −1 | 1 | −1 | −1 | 1 | −1 |
| 199 | 1 | 1 | −1 | 1 | −1 | −1 | −1 | 1 |
| 200 | 1 | 1 | −1 | −1 | 1 | 1 | −1 | −1 |
| 201 | 1 | 1 | −1 | −1 | 1 | −1 | 1 | −1 |

TABLE 3-continued

| Codebook of the lower rate quantizer (LRQ) | | | | | | | | |
|---|---|---|---|---|---|---|---|---|
| Index | Coderword | | | | | | | |
| 202 | 1 | 1 | −1 | −1 | 1 | −1 | −1 | 1 |
| 203 | 1 | 1 | −1 | −1 | −1 | −1 | 1 | 1 |
| 204 | 1 | 1 | −1 | −1 | −1 | 1 | −1 | 1 |
| 205 | 1 | 1 | −1 | −1 | −1 | 1 | 1 | −1 |
| 206 | 1 | −1 | 1 | 1 | 1 | −1 | −1 | −1 |
| 207 | 1 | −1 | 1 | 1 | −1 | 1 | −1 | −1 |
| 208 | 1 | −1 | 1 | 1 | −1 | −1 | 1 | −1 |
| 209 | 1 | −1 | 1 | 1 | −1 | −1 | −1 | 1 |
| 210 | 1 | −1 | 1 | −1 | 1 | 1 | −1 | −1 |
| 211 | 1 | −1 | 1 | −1 | 1 | −1 | 1 | −1 |
| 212 | 1 | −1 | 1 | −1 | 1 | −1 | −1 | 1 |
| 213 | 1 | −1 | 1 | −1 | −1 | −1 | 1 | 1 |
| 214 | 1 | −1 | 1 | −1 | −1 | 1 | −1 | 1 |
| 215 | 1 | −1 | 1 | −1 | −1 | 1 | 1 | −1 |
| 216 | 1 | −1 | −1 | −1 | −1 | 1 | 1 | 1 |
| 217 | 1 | −1 | −1 | −1 | 1 | −1 | 1 | 1 |
| 218 | 1 | −1 | −1 | −1 | 1 | 1 | −1 | 1 |
| 219 | 1 | −1 | −1 | −1 | 1 | 1 | 1 | −1 |
| 220 | 1 | −1 | −1 | 1 | 1 | 1 | −1 | −1 |
| 221 | 1 | −1 | −1 | 1 | 1 | −1 | 1 | −1 |
| 222 | 1 | −1 | −1 | 1 | 1 | −1 | −1 | 1 |
| 223 | 1 | −1 | −1 | 1 | −1 | −1 | 1 | 1 |
| 224 | 1 | −1 | −1 | 1 | −1 | 1 | −1 | 1 |
| 225 | 1 | −1 | −1 | 1 | −1 | 1 | 1 | −1 |
| 226 | 1 | 1 | −1 | −1 | −1 | −1 | −1 | −1 |
| 227 | 1 | −1 | 1 | −1 | −1 | −1 | −1 | −1 |
| 228 | 1 | −1 | −1 | 1 | −1 | −1 | −1 | −1 |
| 229 | 1 | −1 | −1 | −1 | 1 | −1 | −1 | −1 |
| 230 | 1 | −1 | −1 | −1 | −1 | 1 | −1 | −1 |
| 231 | 1 | −1 | −1 | −1 | −1 | −1 | 1 | −1 |
| 232 | 1 | −1 | −1 | −1 | −1 | −1 | −1 | 1 |
| 233 | −1 | 1 | 1 | −1 | −1 | −1 | −1 | −1 |
| 234 | −1 | 1 | −1 | 1 | −1 | −1 | −1 | −1 |
| 235 | −1 | 1 | −1 | −1 | 1 | −1 | −1 | −1 |
| 236 | −1 | 1 | −1 | −1 | −1 | 1 | −1 | −1 |
| 237 | −1 | 1 | −1 | −1 | −1 | −1 | 1 | −1 |
| 238 | −1 | 1 | −1 | −1 | −1 | −1 | −1 | 1 |
| 239 | −1 | −1 | 1 | 1 | −1 | −1 | −1 | −1 |
| 240 | −1 | −1 | 1 | −1 | 1 | −1 | −1 | −1 |
| 241 | −1 | −1 | 1 | −1 | −1 | 1 | −1 | −1 |
| 240 | −1 | −1 | 1 | −1 | −1 | −1 | 1 | −1 |
| 243 | −1 | −1 | 1 | −1 | −1 | −1 | −1 | 1 |
| 244 | −1 | −1 | −1 | 1 | 1 | −1 | −1 | −1 |
| 245 | −1 | −1 | −1 | 1 | −1 | 1 | −1 | −1 |
| 246 | −1 | −1 | −1 | 1 | −1 | −1 | 1 | −1 |
| 247 | −1 | −1 | −1 | 1 | −1 | −1 | −1 | 1 |
| 248 | −1 | −1 | −1 | −1 | 1 | 1 | −1 | −1 |
| 249 | −1 | −1 | −1 | −1 | 1 | −1 | 1 | −1 |
| 250 | −1 | −1 | −1 | −1 | 1 | −1 | −1 | 1 |
| 251 | −1 | −1 | −1 | −1 | −1 | 1 | 1 | −1 |
| 252 | −1 | −1 | −1 | −1 | −1 | 1 | −1 | 1 |
| 253 | −1 | −1 | −1 | −1 | −1 | −1 | 1 | 1 |
| 254 | −1 | −1 | −1 | −1 | −1 | −1 | −1 | −1 |
| 255 | 1 | 1 | 1 | 1 | 1 | 1 | 1 | 1 |

TABLE 4

| Leaders of the codevectors of LRQ | | | | | | | | |
|---|---|---|---|---|---|---|---|---|
| Index | Leader | | | | | | | |
| 0 | 0 | 0 | 0 | 0 | 0 | 0 | 0 | 1 |
| 1 | 2 | 0 | 0 | 0 | 0 | 0 | 0 | 0 |
| 2 | 0 | 0 | 0 | 0 | 0 | 0 | −2 | −2 |
| 3 | 2 | 0 | 0 | 0 | 0 | 0 | 0 | −2 |
| 4 | 2 | 2 | 0 | 0 | 0 | 0 | 0 | 0 |
| 5 | 1 | 1 | 1 | 1 | 1 | 1 | −1 | −1 |
| 6 | 1 | 1 | 1 | 1 | −1 | −1 | −1 | −1 |
| 7 | 1 | 1 | −1 | −1 | −1 | −1 | −1 | −1 |
| 8 | −1 | −1 | −1 | −1 | −1 | −1 | −1 | −1 |
| 9 | 1 | 1 | 1 | 1 | 1 | 1 | 1 | 1 |

TABLE 5

| Flag vectors of the leaders of LRQ | | | | | | | | |
|---|---|---|---|---|---|---|---|---|
| Index | Flag vector | | | | | | | |
| 0 | 0 | 0 | 0 | 0 | 0 | 0 | 0 | 1 |
| 1 | 1 | 0 | 0 | 0 | 0 | 0 | 0 | 0 |
| 2 | 0 | 0 | 0 | 0 | 0 | 0 | 1 | 1 |
| 3 | 1 | 0 | 0 | 0 | 0 | 0 | 0 | 1 |
| 4 | 1 | 1 | 0 | 0 | 0 | 0 | 0 | 0 |
| 5 | 0 | 0 | 0 | 0 | 0 | 0 | 1 | 1 |
| 6 | 0 | 0 | 0 | 0 | 1 | 1 | 1 | 1 |
| 7 | 0 | 0 | 1 | 1 | 1 | 1 | 1 | 1 |
| 8 | 1 | 1 | 1 | 1 | 1 | 1 | 1 | 1 |
| 9 | 0 | 0 | 0 | 0 | 0 | 0 | 0 | 0 |

TABLE 6

| Index offsets related to the leaders for indexing the codevectors of LRQ | |
|---|---|
| Index | Index offset |
| 0 | 0 |
| 1 | 8 |
| 2 | 16 |
| 3 | 44 |
| 4 | 100 |
| 5 | 128 |
| 6 | 128 |
| 7 | 128 |
| 8 | 128 |
| 9 | 128 |

TABLE 7

| Index increments related to the codevectors of LRQ | |
|---|---|
| Index | Increment |
| 0 | 127 |
| 1 | 0 |
| 2 | 1 |
| 3 | 0 |
| 4 | 2 |
| 5 | 1 |
| 6 | 7 |
| 7 | 0 |
| 8 | 3 |
| 9 | 2 |
| 10 | 8 |
| 11 | 0 |
| 12 | 13 |
| 13 | 0 |
| 14 | 0 |
| 15 | 28 |
| 16 | 4 |
| 17 | 3 |
| 18 | 9 |
| 19 | 0 |
| 20 | 14 |
| 21 | 0 |
| 22 | 0 |
| 23 | 29 |
| 24 | 18 |
| 25 | 0 |
| 26 | 0 |
| 27 | 33 |
| 28 | 0 |
| 29 | 43 |
| 30 | 88 |
| 31 | 0 |
| 32 | 5 |
| 33 | 4 |
| 34 | 10 |
| 35 | 0 |

TABLE 7-continued

| Index increments related to the codevectors of LRQ | |
|---|---|
| Index | Increment |
| 36 | 15 |
| 37 | 0 |
| 38 | 0 |
| 39 | 30 |
| 40 | 19 |
| 41 | 0 |
| 42 | 0 |
| 43 | 34 |
| 44 | 0 |
| 45 | 44 |
| 46 | 89 |
| 47 | 0 |
| 48 | 22 |
| 49 | 0 |
| 50 | 0 |
| 51 | 37 |
| 52 | 0 |
| 53 | 47 |
| 54 | 95 |
| 55 | 0 |
| 56 | 0 |
| 57 | 57 |
| 58 | 85 |
| 59 | 0 |
| 60 | 75 |
| 61 | 0 |
| 62 | 0 |
| 63 | 125 |
| 64 | 6 |
| 65 | 5 |
| 66 | 11 |
| 67 | 0 |
| 68 | 16 |
| 69 | 0 |
| 70 | 0 |
| 71 | 31 |
| 72 | 20 |
| 73 | 0 |
| 74 | 0 |
| 75 | 35 |
| 76 | 0 |
| 77 | 45 |
| 78 | 90 |
| 79 | 0 |
| 80 | 23 |
| 81 | 0 |
| 82 | 0 |
| 83 | 38 |
| 84 | 0 |
| 85 | 48 |
| 86 | 96 |
| 87 | 0 |
| 88 | 0 |
| 89 | 58 |
| 90 | 86 |
| 91 | 0 |
| 92 | 76 |
| 93 | 0 |
| 94 | 0 |
| 95 | 124 |
| 96 | 25 |
| 97 | 0 |
| 98 | 0 |
| 99 | 42 |
| 100 | 0 |
| 101 | 52 |
| 102 | 94 |
| 103 | 0 |
| 104 | 0 |
| 105 | 62 |
| 106 | 84 |
| 107 | 0 |
| 108 | 74 |
| 109 | 0 |
| 110 | 0 |
| 111 | 122 |

TABLE 7-continued

| Index increments related to the codevectors of LRQ | |
|---|---|
| Index | Increment |
| 112 | 0 |
| 113 | 56 |
| 114 | 81 |
| 115 | 0 |
| 116 | 71 |
| 117 | 0 |
| 118 | 0 |
| 119 | 119 |
| 120 | 67 |
| 121 | 0 |
| 122 | 0 |
| 123 | 115 |
| 124 | 0 |
| 125 | 110 |
| 126 | 104 |
| 127 | 0 |
| 128 | 7 |
| 129 | 6 |
| 130 | 12 |
| 131 | 0 |
| 132 | 17 |
| 133 | 0 |
| 134 | 0 |
| 135 | 32 |
| 136 | 21 |
| 137 | 0 |
| 138 | 0 |
| 139 | 36 |
| 140 | 0 |
| 141 | 46 |
| 142 | 91 |
| 143 | 0 |
| 144 | 24 |
| 145 | 0 |
| 146 | 0 |
| 147 | 39 |
| 148 | 0 |
| 149 | 49 |
| 150 | 97 |
| 151 | 0 |
| 152 | 0 |
| 153 | 59 |
| 154 | 87 |
| 155 | 0 |
| 156 | 77 |
| 157 | 0 |
| 158 | 0 |
| 159 | 123 |
| 160 | 26 |
| 161 | 0 |
| 162 | 0 |
| 163 | 41 |
| 164 | 0 |
| 165 | 51 |
| 166 | 93 |
| 167 | 0 |
| 168 | 0 |
| 169 | 61 |
| 170 | 83 |
| 171 | 0 |
| 172 | 73 |
| 173 | 0 |
| 174 | 0 |
| 175 | 121 |
| 176 | 0 |
| 177 | 55 |
| 178 | 80 |
| 179 | 0 |
| 180 | 70 |
| 181 | 0 |
| 182 | 0 |
| 183 | 118 |
| 184 | 66 |
| 185 | 0 |
| 186 | 0 |
| 187 | 114 |

TABLE 7-continued

| Index increments related to the codevectors of LRQ | |
|---|---|
| Index | Increment |
| 188 | 0 |
| 189 | 109 |
| 190 | 103 |
| 191 | 0 |
| 192 | 27 |
| 193 | 0 |
| 194 | 0 |
| 195 | 40 |
| 196 | 0 |
| 197 | 50 |
| 198 | 92 |
| 199 | 0 |
| 200 | 0 |
| 201 | 60 |
| 202 | 82 |
| 203 | 0 |
| 204 | 72 |
| 205 | 0 |
| 206 | 0 |
| 207 | 120 |
| 208 | 0 |
| 209 | 54 |
| 210 | 79 |
| 211 | 0 |
| 212 | 69 |
| 213 | 0 |
| 214 | 0 |
| 215 | 117 |
| 216 | 65 |
| 217 | 0 |
| 218 | 0 |
| 219 | 113 |
| 220 | 0 |
| 221 | 108 |
| 222 | 102 |
| 223 | 0 |
| 224 | 0 |
| 225 | 53 |
| 226 | 78 |
| 227 | 0 |
| 228 | 68 |
| 229 | 0 |
| 230 | 0 |
| 231 | 116 |
| 232 | 64 |
| 233 | 0 |
| 234 | 0 |
| 235 | 112 |
| 236 | 0 |
| 237 | 107 |
| 238 | 101 |
| 239 | 0 |
| 240 | 63 |
| 241 | 0 |
| 240 | 0 |
| 243 | 111 |
| 244 | 0 |
| 245 | 106 |
| 246 | 100 |
| 247 | 0 |
| 248 | 0 |
| 249 | 105 |
| 250 | 99 |
| 251 | 0 |
| 252 | 98 |
| 253 | 0 |
| 254 | 0 |
| 255 | 126 |

Huffman Coding of Quantization Indices

The MLT coefficients are not uniformly distributed. It has been observed that the 8-dimensional coefficient vectors have a high concentration of probability around the origin. Therefore, the codebooks of lattice vector quantizers are not optimal for non-uniform sources.

To improve the performance of the higher rate quantizer presented above, a Huffman coder may be used to code the indices of quantization. Due to the low-rate (<2 bits/sample) coding, most of the "extra" sub-frames corresponding to the band of 14-22 kHz are not quantized by the higher rate quantizer. Therefore, Huffman coding is not used for the extra sub-frames.

For a given rate R bits/dimension (1<R<6), an 8-dimensional coefficient vector x is quantized by the higher rate quantizer and the index vector $k=(k_1, k_2, k_3, k_4, k_5, k_6, k_7, k_8)$ of the best codevector y is obtained with $0 \leqq k_i < 2^R$, i=1, 2, . . . , 8. Then, the components of k are Huffman coded according to Tables 8-11.

By using Huffman coding, the quantization indices are coded with a variable number of bits. For the given rate R, the more frequent indices require bits less than R and the less frequent indices may need bits more than R. Therefore, the code length is verified after Huffman coding and three flag bits are used in a frame to indicate whether Huffman coding is applied to each of the first three groups of sub-frames. The flag bits are transmitted as the side information to the decoder. For a group of sub-frames, the quantization indices are Hoffman coded only if the number of bits required by using Huffman coding is not greater than the total number of bits available to this group. In this case, the Huffman-coding flag is set to one.

For a percussion-type signal, however, Huffman coding is no longer applied to quantization indices. The quantization indices are directly transmitted to the decoder.

At the decoder, the Huffman-coding flags are checked. If the Huffman-coding flag of a group of sub-frames is set, the coded data for this group is Huffman decoded to obtain the quantization indices. Otherwise, the coded data is directly used as the quantization indices.

TABLE 8

Huffman codes for the quantization indices of HRQ with the rate of 2 bits/dimension

| Index | Huffman code | Code value | Number of bits |
|---|---|---|---|
| 0 | 0 | 0 | 1 |
| 1 | 110 | 6 | 3 |
| 2 | 111 | 7 | 3 |
| 3 | 10 | 2 | 2 |

TABLE 9

Huffman codes for the quantization indices of HRQ with the rate of 3 bits/dimension

| Index | Huffman code | Code value | Number of bits |
|---|---|---|---|
| 0 | 00 | 0 | 2 |
| 1 | 01 | 1 | 2 |
| 2 | 1001 | 9 | 4 |
| 3 | 10000 | 16 | 5 |
| 4 | 10001 | 17 | 5 |
| 5 | 1010 | 10 | 4 |
| 6 | 1011 | 11 | 4 |
| 7 | 11 | 3 | 2 |

TABLE 10

Huffman codes for the quantization indices of HRQ with the rate of 4 bits/dimension

| Index | Huffman code | Code value | Number of bits |
|---|---|---|---|
| 0 | 00 | 0 | 2 |
| 1 | 110 | 6 | 3 |
| 2 | 0110 | 6 | 4 |
| 3 | 0111 | 7 | 4 |
| 4 | 10100 | 20 | 5 |
| 5 | 10101 | 21 | 5 |
| 6 | 10110 | 22 | 5 |
| 7 | 101110 | 46 | 6 |
| 8 | 101111 | 47 | 6 |
| 9 | 10000 | 16 | 5 |
| 10 | 10001 | 17 | 5 |
| 11 | 10010 | 18 | 5 |
| 12 | 10011 | 19 | 5 |
| 13 | 0100 | 4 | 4 |
| 14 | 0101 | 5 | 4 |
| 15 | 111 | 7 | 3 |

TABLE 11

Huffman codes for the quantization indices of HRQ with the rate of 5 bits/dimension

| Index | Huffman code | Code value | Number of bits |
|---|---|---|---|
| 0 | 00 | 0 | 2 |
| 1 | 010 | 2 | 3 |
| 2 | 1000 | 8 | 4 |
| 3 | 10100 | 20 | 5 |
| 4 | 10101 | 21 | 5 |
| 5 | 110000 | 48 | 6 |
| 6 | 110001 | 49 | 6 |
| 7 | 110010 | 50 | 6 |
| 8 | 110011 | 51 | 6 |
| 9 | 1110000 | 112 | 7 |
| 10 | 1110001 | 113 | 7 |
| 11 | 1110010 | 114 | 7 |
| 12 | 1110011 | 115 | 7 |
| 13 | 1110100 | 116 | 7 |
| 14 | 1110101 | 117 | 7 |
| 15 | 1110110 | 118 | 7 |
| 16 | 1110111 | 119 | 7 |
| 17 | 1111000 | 120 | 7 |
| 18 | 1111001 | 121 | 7 |
| 19 | 1111010 | 122 | 7 |
| 20 | 1111011 | 123 | 7 |
| 21 | 1111100 | 124 | 7 |
| 22 | 1111101 | 125 | 7 |
| 23 | 111111 | 63 | 6 |
| 24 | 110100 | 52 | 6 |
| 25 | 110101 | 53 | 6 |
| 26 | 110110 | 54 | 6 |
| 27 | 110111 | 55 | 6 |
| 28 | 10110 | 22 | 5 |
| 29 | 10111 | 23 | 5 |
| 30 | 1001 | 9 | 4 |
| 31 | 011 | 3 | 3 |

Bit Stream Generated by the Encoder

Figure 3A:
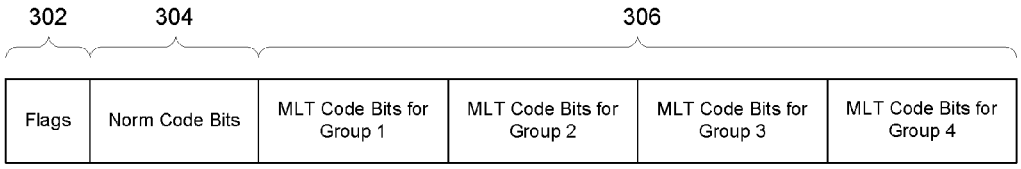
FIG. 3A depicts an exemplary encoded bit stream according to an embodiment of the present disclosure.

FIG. 3A illustrates an example of an encoded bit stream according to an embodiment of the present disclosure. In one embodiment, the total number of bits in a frame is 640, 960, and 1280 bits, corresponding to the bit rates of 32 kbps, 48 kbps, and 64 kbps, respectively. The bit stream transmitted on the channel may be comprised of 3 parts: flags bits, norm code bits, and code bits for MLT coefficients. The flag bits may be transmitted first, the norm code bits next, and the code bits for MLT coefficients last.

The flag section 302 contains a number of flag bits used for various purposes. In this example, the flag bits may comprise a mode flag that is used to indicate the mode for the current frame and transmitted to the decoder. For example, the mode flag may be used to indicate a percussion-type signal mode. As another example, the mode flag may be used to indicate speech and general music. The flags may also comprise a flag used to indicate how many sub-frames to be coded at 32 kbps and transmitted as side information to the decoder. The next part has a fixed length. In this example, it has four bits. The four bits are used to indicate whether Huffman coding is used for norms, group 1 coefficients indices, group 2 coefficients indices, and group 3 coefficients indices. Group 4 typically does not use Huffman coding because typically, group 4 coefficients have very few bits and Huffman coding typically does not reduce bit requirement.

The bit stream may further comprise the norm code bits 304 of all the sub-frames. If Huffman coding is not used, then the length is fixed. In the example, the fixed length is 170 bits (34 norms×5 bits per norm). If Huffman coding is used, then the length is determined by Huffman coding.

The bit stream may further comprise the encoded coefficient indices for groups 1-4 306. The amount of bits allocated to each group or each coefficient can vary. They are determined by the bit allocation according to the norm of each sub-frame. The indices for groups 1-3 may also depend on whether Huffman coding is used or not. The indices for group 4 typically do not use Huffman coding. But the amount of bits allocated to group 4 may still vary because the number of bits for the other parts may vary. When other groups use fewer bits due to Huffman coding, those saved bits may be used for group 4.

Figure 3B:
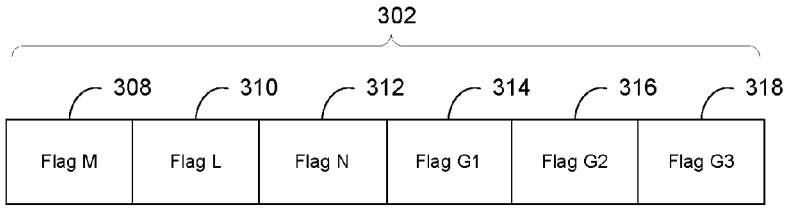
FIG. 3B depicts an exemplary structure of flag bits according to an embodiment of the present disclosure.

FIG. 3B depicts an exemplary structure for the flag bits 302 in accordance with one embodiment of the disclosure. In this example, the flag bits 302 may comprise a Flag M 308 to indicate the mode for the current frame and transmitted to the decoder. In a percussion-type signal mode, only the mode flag 308 may be transmitted, and the other flags need not be transmitted. In the speech and general music mode, all of the flags may be transmitted. The flag bits 302 may further comprise a Flag L 310 to indicate how many sub-frames are to be coded at a low bit-rate, e.g., 32 kbps. The flag bits 302 may further comprise a Flag N 312 to indicate whether the norms are Huffman coded. The flag bits 302 may further comprise Flags G1 through G3 to indicate whether each group of MLT coefficients (in this example, Group 1 through Group 3) are Huffman coded.

Figure 3C:
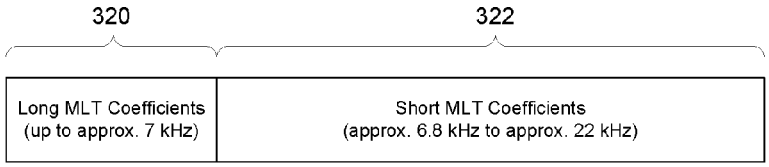
FIG. 3C depicts an exemplary structure of transform coefficients according to an embodiment of the present disclosure.

FIG. 3C depicts an exemplary structure for the combined set of transform coefficients which are quantized (and possibly Huffman coded) with the coefficient code bits 306 in accordance with one embodiment of the disclosure. In this example, the boundary frequency is approximately 7 kHz. The long frame transform coefficients 320 represent frequencies up to approximately 7 kHz. The short frame transform coefficients 322 represent frequencies from approximately 6.8 kHz to approximately 22 kHz. The long frame transform and the short frame transform may overlap at their boundaries to makes the transition smoother.

Figure 3D:
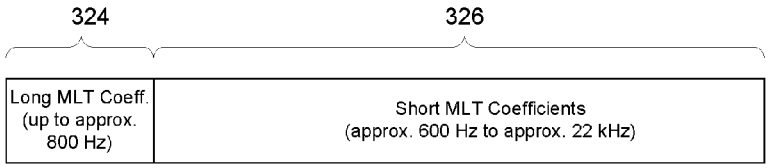
FIG. 3D depicts an exemplary structure of transform coefficients according to another embodiment of the present disclosure.

FIG. 3D depicts another exemplary structure for the combined set of transform coefficients which are quantized (and possibly Huffman coded) with the coefficient code bits 306 in accordance with another embodiment of the disclosure. In this example, the boundary frequency is approximately 800 Hz. The long frame transform coefficients 324 represent frequencies up to approximately 800 Hz. The short frame transform coefficients 326 represent frequencies from approximately 600 Hz to approximately 22 kHz. The long frame transform and the short frame transform may overlap at their boundaries to makes the transition smoother.

Encoder Processes

Figure 4:
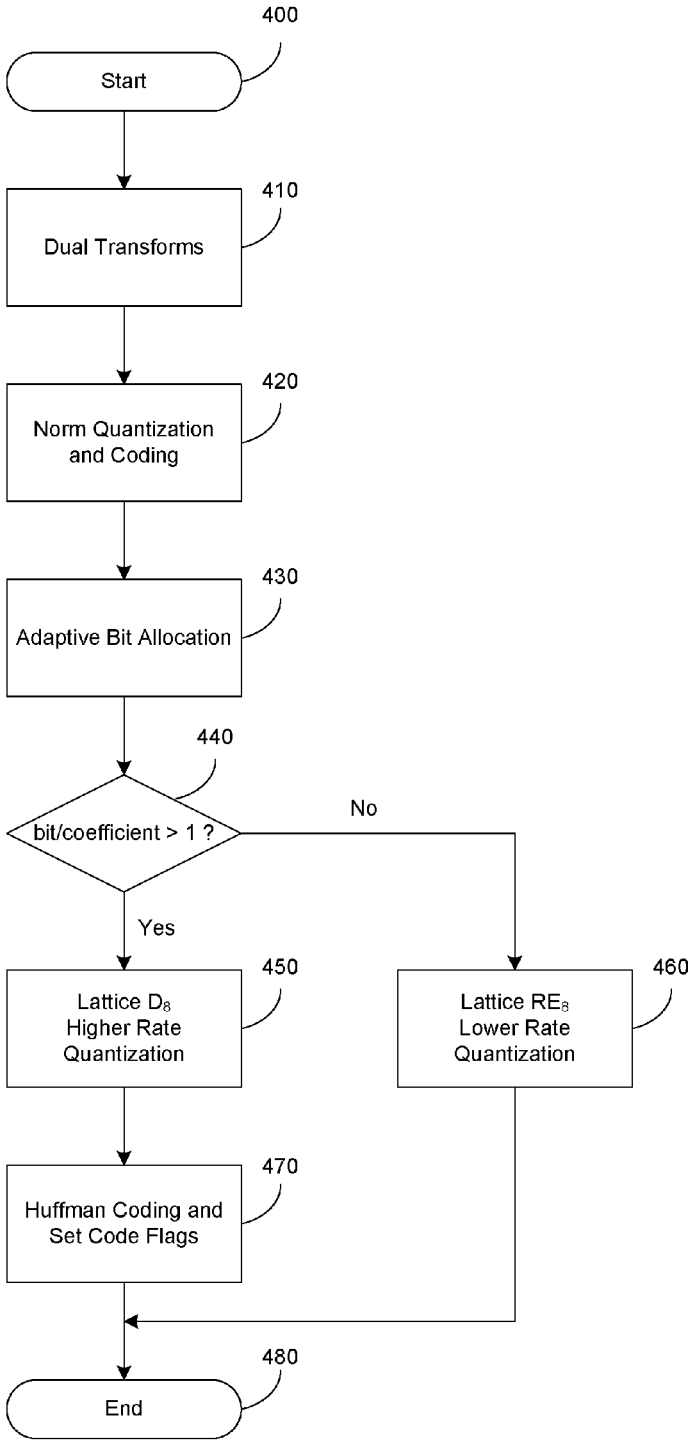
FIG. 4 depicts an exemplary process flow diagram of an encoding process according to an embodiment of the present disclosure.

Reference is now made to FIG. 4 which depicts an exemplary process flow diagram for an overall encoding process in accordance with one embodiment of the present disclosure. The encoding process begins at step 400. In step 410, two MLT transforms may be applied to the audio signal so that the audio samples in time are converted to frames of transform coefficients. The longer frame transform coefficients are used for signals of lower frequencies (e.g., approximately 20 Hz to approximately 7 kHz) and the shorter frame transform coefficients are used for signals of higher frequencies (e.g., approximately 6.8 kHz to approximately 22 kHz). In another embodiment, a single transform may be applied to the audio signal.

The MLT coefficients may be grouped into 4 groups with 34 sub-frames. In step 420, the norm for each sub-frame is calculated and quantized with a fixed number of bits. Each sub-frame is then normalized by its quantized norm and the normalized transform coefficients are obtained. Huffman coding may be tried for all quantized norms. If the number of bits used is less than the total number of bits allocated for norm quantization, then Huffman coding may be used. The Huffman flag (Flag N) is set, and the extra bits are stored in a bits remainder. If the number of bits used is not less, then Huffman coding is not used, and the Huffman flag is cleared. The remainder is the total number of bits, minus the 6 flag bits, and the bits used by norms.

In step 430, an adaptive bit allocation scheme may be used to allocate the available bits in a frame among the sub-frames. First, all bits of each sub-frames are set to zero (there are a total of 34 sub-frames), and the bits remainder is set to the total bits available. Next, the largest norm of a sub-frame is found, and 1 bit is allocated for each coefficient in the sub-frame, at a total of M; then let its norm=norm/2, Remainder=Remainder−M. For a sub-frame having 16 coefficients, then M=16, and for a sub-frame having 24 or 32 coefficients, then M is 24 or 32, respectively. If the remainder is less than 16, then stop allocation; else, repeat the last step. When bit allocation is done, the remainder is less than 16. Some sub-frames are allocated several bits per coefficient; others may have zero bits.

In decision 440, if the bit(s) per coefficient is greater than 1, then the quantization may be done by Lattice $D_8$, higher rate quantization in step 450; otherwise, quantization may be done by lower rate quantization using Lattice $RE_8$ in step 460. The bits allocated to each of the groups are now known.

In step 470, Huffman coding may be optionally tried for the quantized coefficients for each sub-frame. The total of the bits needed for each group of the first three groups is added. If the Huffman coded bits are less than the allocated bits, then Huffman coding may be used for that group, and the Huffman code flag for that group is set; and the saved bits are allocated to the remainder bits. If the Huffman coded bits are not less than the fixed allocated bits, then Huffman coding is not used, and Huffman code flag is cleared.

The remainder bits are allocated to the next group according to the bit allocation scheme above. All bits are allocated and the process ends at 480. The bit stream is formed and can be transmitted.

Various modifications may be made to the exemplary encoder process described in connection with FIG. 4. In accordance with some embodiments of the present disclosure, the dual transforms may be optional. In accordance with other embodiments of the present disclosure, there may be fewer than or more than two transforms. In addition, and as explained above, any type of transform, such as MLT, FFT, DCT, etc., may be used.

Decoder Processes

Figure 5:
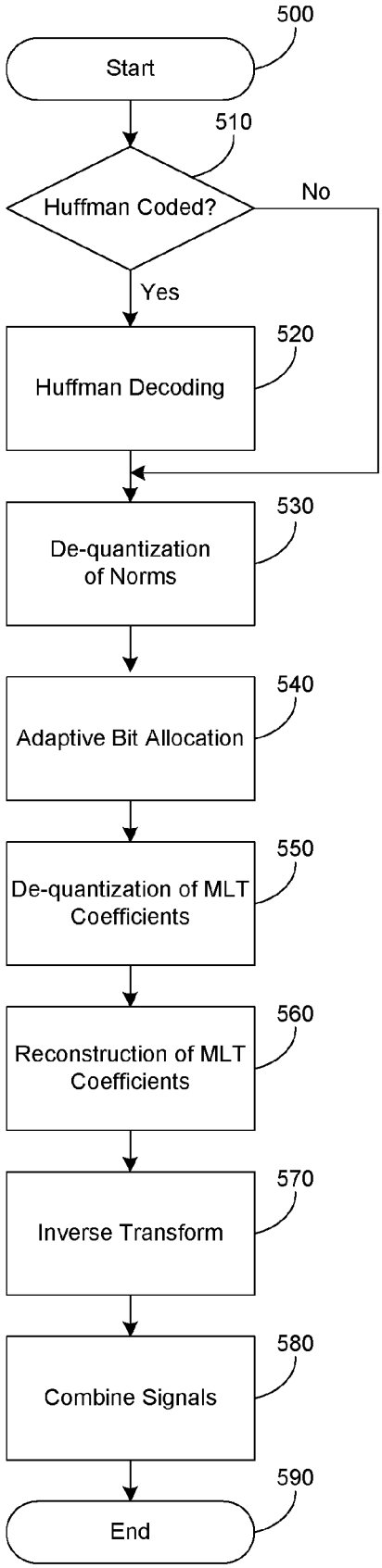
FIG. 5 depicts an exemplary process flow diagram of a decoding process according to an embodiment of the present disclosure.

The decoder processes the encoded bit stream essentially in the reverse order of the encoder. The total bits are known and agreed upon. At the decoder, the data integrity and encoding protocol may be checked to ensure that the appropriated decoder is used for the bit stream. Once the decoder verifies that the bit stream is encoded with the encoder according the example above, then it decodes the bit stream, as depicted in FIG. 5 and described as follows:

Process flow begins at step 500 with receiving the encoded bit stream as input to the decoder. In step 510, the flag bits are checked. For example, whether the norms or the coefficient indices of the first three groups are Huffman coded is determined.

If the norm Huffman code flag is set, then the quantization indices for norms are Huffman decoded in step 520. After all norms are decoded, the total bits used by the norms are then known. The number of bits used to code coefficient indices, which is the remaining bits, is also known.

If the Huffman code flag is not set, then the fixed rate is used in step 530. The number of bits used by the norms is known. The total number of bits for the coefficient indices is known.

The quantized norms are obtained by de-quantizing the quantization indices in step 530. From the quantized norms, adaptive bit allocation 540, which is the same operation of Box 430 in FIG. 4, may be performed to determine which sub-frame has how many bits. If the Huffman flag is set for a group, the received data is Huffman code and has to be decoded for each sub-frame within this group. If the Huffman flag is not set, the received data is the quantization indices of coefficients.

From the quantized norms and quantization indices, the MLT coefficients can be reconstructed in step 560. For sub-frames that are not assigned any bit, their MLT coefficients can be filled with zeros or generated with random numbers. The low frequency coefficients of the one long transform and the high frequency coefficients of four short transforms can be recovered. The high frequencies in the long transform may be filled with zeros; similarly, the low frequencies of the four short transforms may be filled with zeros. Along the boundary of high frequency and low frequency, some form of smooth transition may be used. For example, a simplest smooth function is a gradual slope over a few coefficients near the boundary.

Once all the coefficients of the long transform and the four short transforms are reconstructed, they can be inverse transformed into digital audio samples. In step 570, inverse transformation of the long transform and four short transforms from frequency domain to time domain is performed. For example, dual IMLTs may be applied to the reconstructed MLT coefficients. Now there are two digital audio signals, each covering the same 20 ms time frame.

In step 580, the two time domain signals are combined to form a single audio signal. The signal can be converted to an analog signal and reproduced as sound.

Figure 6:
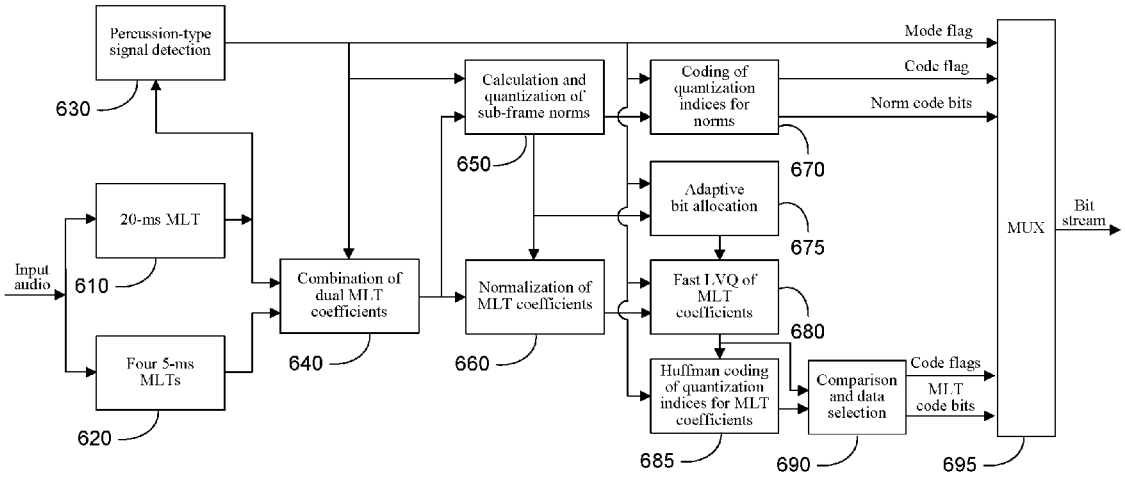
FIG. 6 depicts an exemplary block diagram of an encoder according to an embodiment of the present disclosure.
Figure 7:
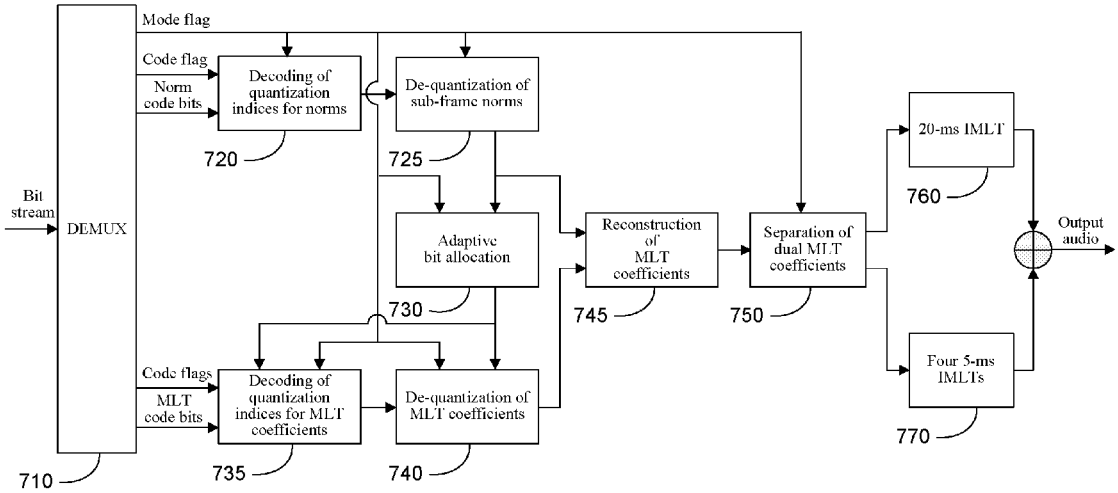
FIG. 7 depicts an exemplary block diagram of a decoder according to an embodiment of the present disclosure.

The methods of various embodiments of the present disclosure may be carried out by hardware, software, firmware, or a combination of any of the foregoing. For example, the methods may be carried out by an encoder or decoder or other processor in an audio system such as a teleconferencing system or a video conferencing system. In addition, the methods of various embodiments of the present disclosure may be applied to streaming audio, for example, via the Internet. FIG. 6 depicts an encoder in accordance with various embodiments of the present disclosure. FIG. 7 depicts a decoder in accordance with various embodiments of the present disclosure. The encoder and decoder may be separate in some embodiments or they may be combined into a codec in other embodiments.

In the encoder of FIG. 6, an input audio signal which has digitally sampled may be fed into at least two transform modules 610 and 620 so that the audio samples in time can be converted to frames of transform coefficients. In other embodiments, the input audio signal may be fed into a single transform. For ease of reference, transform modules 610 and 620 are referred to as MLT modules, although other types of transform modules may be used.

In one embodiment, every 20 ms, the most recent 1920 audio samples may be fed into transform module 610, and every 5 ms, the most recent 480 audio samples may be fed into transform module 620. The longer frame transform module 610 may yield a set of approximately 960 coefficients, and the shorter frame transform module 620 may yield four sets of approximately 240 coefficients each. The longer frame transform coefficients may be used for signals of lower frequencies, and the shorter frame transform coefficients may be used for signals of higher frequencies. For example, in one embodiment, the longer frame transform coefficients represent frequencies between approximately 20 Hz to approximately 7 kHz, and the shorter frame transform coefficients represent frequencies between approximately 6.8 kHz to approximately 22 kHz.

In another embodiment, a module 630 may optionally be provided to indicate presence of a percussion-type signal. If a percussion-type signal is detected, a mode flag indicating a percussion-type mode may be sent to a multiplexer 695 for transmission. If a percussion-type signal is detected, the boundary frequency may be adjusted to approximately 800 Hz. In such a case, the dual-transform coefficients are the combination of the long-transform coefficients representing frequencies of up to 800 Hz and the short-transform coefficients representing frequencies above 600 Hz. In other embodiments, the boundary frequency may be 7 kHz or anywhere between approximately 800 Hz and approximately 7 kHz.

The longer frame transform coefficients and the shorter frame transform coefficients are combined by combiner module 640. The combined coefficients are applied to a norm quantization module 650 that calculates and quantizes the norm for each sub-frame. A coding module 670 is applied to the quantization indices for the norms. The coding module may optionally perform Huffman coding. The resulting norm code bits are fed to multiplexer 695. A Huffman code flag may also be fed to multiplexer 695 to indicate whether the norms are Huffman coded.

The quantized norms from norm quantization module 650 and the combined MLT coefficients from combiner module 640 are fed to a normalization module 660 which normalizes the MLT coefficients. The quantized norms may also be fed to an adaptive bit allocation module 675 which allocates the available bits in a frame among the sub-frames. With the bit allocation completed, the normalized MLT coefficients may then be quantized sub-frame by sub-frame by fast lattice vector quantization module 680. If the bit(s) per coefficient is greater than 1, then the quantization may be done by a higher rate quantizer; otherwise, quantization may be done by a lower rate quantizer. If a percussion-type signal is detected, the maximum quantization rate may be set to 6 bits per coefficient. If a percussion-type signal is not detected, the maximum quantization rate may be set to 5 bits per coefficient.

A Huffman coding module 685 may be optionally applied to the quantization indices for the MLT coefficients. For a percussion-type signal, however, Huffman coding module 685 is not applied to the quantization indices for the MLT coefficients. The resulting Huffman code bits are fed from Huffman coding module 685 to a comparison and data selection module 690. The comparison and data selection module 690 compares the quantization indices output from quantization module 680 to the Huffman code output from Huffman coding module 685. For each group of the first three groups of sub-frames, if the Huffman coded bits are less than the allocated bits, then the Huffman coded bits may be selected for that group, and the Huffman code flag for that group is set; and the saved bits are allocated to the remainder bits. If the Huffman coded bits are not less than the fixed allocated bits, then the quantization indices are selected for that group, and the Huffman code flag is cleared for that group. The selected MLT code bits are fed to multiplexer 695 along with any Huffman code flags. A bit stream is formed and can be transmitted.

The decoder of FIG. 7 is operable to reconstruct the audio signal from the encoded bit stream. The encoded bit stream is provided to a demultiplexer 710 which demultiplexes the data into norm code bits, MLT code bits, and various flags, such as a mode flag, a flag used for the number of sub-frames coded at 32 kbit/s, a Huffman code flag for the norms, and a Huffman code flag for each group of MLT coefficients. For ease of reference, the designations MLT code bits and MLT coefficients are used in this example, although other types of transform modules may have been used.

The norm code bits are fed into a decoding module 720 which decodes the quantization indices for the sub-frame norms. Huffman decoding may be applied if the Huffman code flag (Flag N) indicates Huffman coding was used to encode the norms. A de-quantization module 725 then de-quantizes the sub-frame norms. An adaptive bit allocation module 730 may be used to allocate the available bits in a frame among the sub-frames.

The MLT code bits are fed from the demultiplexer 710 into a decoding module 735 which decodes the quantization indices for the MLT coefficients. Huffman decoding may be applied if any of the Huffman code flags indicates that Huffman coding was used to encode any groups of the MLT coefficients. If no Huffman code flags indicate that Huffman coding was used to encode any groups of the MLT coefficients, the quantization indices pass through to a de-quantization module 740. Thus, the decoded MLT code bits or the quantization indices for the MLT coefficients are fed into de-quantization module 740 which de-quantizes the MLT coefficients.

From the quantized norms and quantization indices, the MLT coefficients can be reconstructed by reconstruction module 745. The MLT coefficients are separated by a separator module 750 into a long frame of MLT coefficients and four sets of short frame MLT coefficients. A long frame inverse transform module 760 is applied to the set of long frame MLT coefficients, and a short frame inverse transform module 770 is applied to the four sets of short frame MLT coefficients. The inverse transform modules 760 and 770 may comprise inverse modulated lapped transform (IMLT) modules. The resulting time domain signals are summed, resulting in an output audio signal which can be converted from digital to analog and reproduced as sound.

Figure 8:
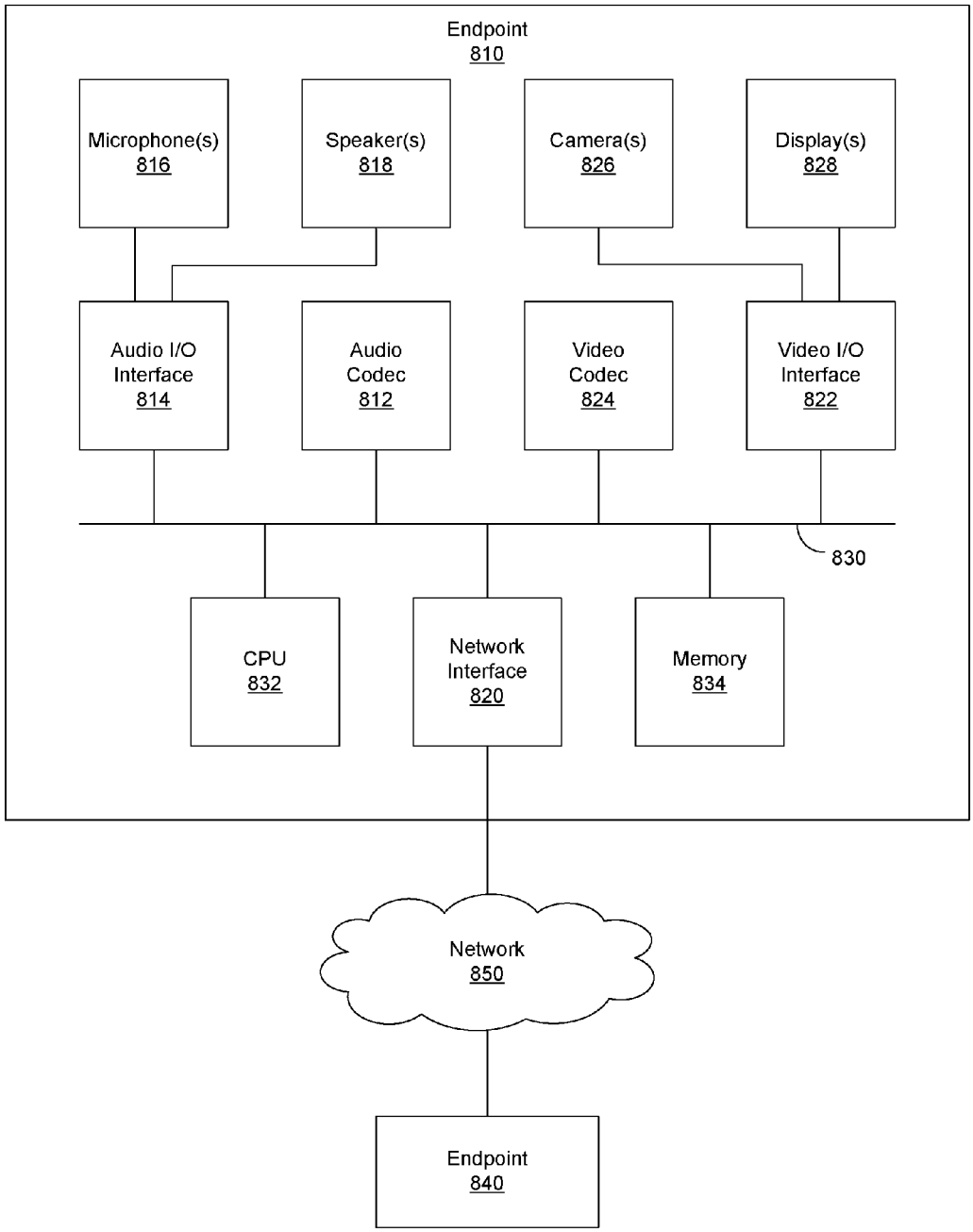
FIG. 8 depicts an exemplary block diagram of a conferencing system according to an embodiment of the present disclosure.

Various embodiments of the present disclosure may find useful application in fields such as audio conferencing, video conferencing, and streaming media, including streaming music or speech. Reference is now made to FIG. 8 which depicts a block diagram of an exemplary conferencing system in accordance with one embodiment of the present disclosure. The system includes a local endpoint 810 operable to communicate with one or more remote endpoints 840 via a network 850. The communications may include the exchange of audio, video, and data. It will be appreciated by those of skill in the art that the video capability is optional, and the endpoint 810 may be a device for audio conferencing without video conferencing capability. For example, the endpoint 810 may comprise a speakerphone or other audio conferencing device. Likewise, each remote endpoint 840 may comprise an audio conferencing device or a video conferencing device.

The local endpoint 810 comprises an audio codec 812 and an audio I/O interface 814. The audio codec 812 may comprise an encoder such as the encoder of FIG. 6. The audio codec may further comprise a decoder such as the decoder of FIG. 7. The audio I/O interface 814 may performs analog-to-digital and digital-to-analog conversion as well as other signal processing tasks in connection with processing audio information received from one or more microphones 816 or sent to one or more speakers 818. The one or more microphones 816 may comprise gated microphones with intelligent microphone mixing and dynamic noise reduction functions. In some embodiments, the one or more microphones 816 may be integral with the endpoint 810, or they may be separate from the endpoint 810, or a combination. Likewise, the one or more speakers 818 may be integral with the endpoint 810, or separate from the endpoint 810, or a combination. If they are separate from the endpoint 810, the microphones 816 and the speakers 818 may send and receive information via a wired connection or a wireless connection.

The local endpoint 810 can acquire audio information (typically representative of speech and sounds of the local conferencing participant(s)) generated by the one or more microphones 816. The local endpoint 810 digitizes and processes the acquired audio information. The audio is encoded and transmitted to the one or more remote endpoints 840 via network interface 820.

The endpoint 810 can receive audio information (typically representative of the speech and sounds of the remote conference participant(s)) from the remote conference endpoint(s) 840. The received audio information is received by the network interface 820. The received audio information is decoded, processed, converted to analog, and reproduced as audio via the one or more speakers 818.

In some embodiments, the endpoint 810 may optionally include video capability. In such embodiments, the endpoint 810 may comprise a video codec 822, a video I/O interface 824, one or more video cameras 826, and one or more display devices 828. The one or more cameras 826 may be integral with the endpoint 810, or separate from the endpoint 810, or a combination. Likewise, the one or more display devices 828 may be integral with the endpoint 810, or separate from the endpoint 810, or a combination.

In the video-capable embodiments, the endpoint 810 can acquire video information (typically representative of the images of the local conferencing participant(s)) generated by one or more cameras 826. The endpoint 810 processes the acquired video information, and transmits the processed information to the one or more remote endpoints 840 via the network interface 820. The video input/output interface converts and processes video information received from one or more cameras 826 and sent to one or more video monitors 828. The video codec 824 encodes and decodes video information.

The endpoint 810 can also receive video information (typically representative of the images of the remote conference participant(s)) from the remote endpoint(s) 840. The received video information is processed by the endpoint 810 and the processed video information is directed to the one or more display devices 828. The endpoint 810 may also receive input from or direct output to other peripheral devices, such as a videocassette player/recorder, document camera or LCD projector, etc.

The various components of endpoint 810 may be interconnected for communication by at least one bus 830. The components of endpoint 810 may also comprise a central processing unit (CPU) 832. The CPU 832 interprets and executes program instructions which may be loaded from a memory 834. The memory 834, which may variously include volatile RAM, non-volatile ROM, and/or storage devices such as magnetic disk drives or CD-ROMS, stores executable programs, data files, and other information.

Additional components and features may be present in endpoint 810. For example, endpoint 810 may comprise a module for echo cancellation or reduction to allow for full-duplex operation.

The one or more remote endpoints 840 may comprise similar components as described above with respect to local endpoint 810. The network 850 may comprise a PSTN (Public Switched Telephone Network), or an IP-based network.

While illustrative embodiments of the invention have been illustrated and described, it will be appreciated that various changes can be made therein without departing from the spirit and scope of the invention. The invention has been explained with reference to exemplary embodiments. It will be evident to those skilled in the art that various modifications may be made thereto without departing from the broader spirit and scope of the invention. Further, although the invention has been described in the context of its implementation in particular environments and for particular applications, those skilled in the art will recognize that the present invention's usefulness is not limited thereto and that the invention can be beneficially utilized in any number of environments and implementations. The foregoing description and drawings are, accordingly, to be regarded in an illustrative rather than a restrictive sense.

What is claimed is:

1. A quantization method for use in coding audio signals, the method comprising:

transforming the audio signal from time domain into frequency domain to form source vectors;

constructing a codebook from a truncated lattice, wherein the lattice comprises a multi-dimensional lattice of all codevectors having integer coordinates with an even sum; and quantizing outlier source vectors lying outside of the truncated lattice, wherein quantizing outlier source vectors comprises scaling each outlier source vector by a scale factor corresponding to a rate of quantization associated with the outlier source vector, to form a rate-scaled outlier source vector.

2. The method of claim 1, wherein the act of quantizing outlier source vectors comprises:

(a) scaling each rate-scaled outlier source vector by one-half, forming a scaled outlier source vector;

(b) determining a nearest lattice point u to the scaled outlier source vector;

(c) computing an index vector j of u;

(d) determining a codevector y from the index vector j;

(e) comparing y and u;

(f) repeating the acts (a) through (e) if y is different from u; otherwise (g) adding one-sixteenth of the scaled outlier source vector to the scaled outlier source vector, forming a new scaled outlier source vector;

(h) repeating the acts (b) through (e);

(i) repeating the acts (g) through (h) if y is identical to u; otherwise stopping the process.

3. The method of claim 1, wherein the lattice comprises an eight-dimensional $D_8$ lattice.

4. The method of claim 1, further comprising:

variable bit-length coding indices of quantization.

5. A quantization method for use in coding an audio signal, the method comprising:

transforming the audio signal from time domain into frequency domain to form source vectors;

constructing a codebook from a lattice comprising a multi-dimensional lattice of all codevectors falling on concentric spheres; and quantizing source vectors, wherein quantizing a source vector comprises shifting the source vector.

6. The method of claim 5, wherein the act of quantizing further comprises:

(a) scaling the shifted source vector to form a scaled source vector;

(b) reordering components of the scaled source vector in descending order;

(c) determining a leader vector l of the reordered vector based on a mean-squared error;

(d) arranging an order of the components of the leader vector l in an original order of the components of the scaled source vector to obtain the codevector y;

(e) determining a flag vector of the leader vector l;

(f) obtaining a vector z by arranging an order of components of the flag vector in an original order;

(g) determining an index offset K related to the leader vector l;

(h) adjusting the offset K by adding 28 if the leader vector l is (2, 0, 0, 0, 0, 0, 0, −2) and the codevector y comprises a component of 2 with an index lower than that of a component of −2;

(i) computing a vector dot product $i=zp^T$, wherein p=(1, 2, 4, 8, 16, 32, 64, 128);

(j) determining an index increment j related to the codevector y;

(k) computing an index k of the codevector y, wherein k=K+j.

7. The method of claim 5, wherein the lattice comprises a rotated Gosset lattice $RE_8$.

8. A quantization method for use in coding an audio signal, the method comprising:

transforming the audio signal from time domain samples into frequency domain to form transform coefficients;

using a first lattice vector quantizer to quantize transform coefficients at rates greater than 1 bit per coefficient; and using a second lattice vector quantizer to quantize transform coefficients at a rate of 1 bit per coefficient.

9. The method of claim 8, wherein the act of using a first lattice vector quantizer comprises:

constructing a codebook from a truncated lattice, wherein the lattice comprises a multi-dimensional lattice of all codevectors having integer coordinates with an even sum; and quantizing outlier source vectors lying outside of the truncated lattice.

10. The method of claim 8, wherein the act of using a second lattice vector quantizer comprises:

constructing a codebook from a lattice comprising a multi-dimensional lattice of all codevectors falling on concentric spheres; and quantizing source vectors.

11. The method of claim 8, further comprising:

variable bit-length coding indices of quantization for the coefficients quantized by the first lattice vector quantizer.

12. A method of encoding an audio signal, the method comprising:

transforming groups of samples of the audio signal from time domain to frequency domain to form frames of transform coefficients;

grouping each frame of transform coefficients into a plurality of groups, wherein each group contains a plurality of sub-frames, and wherein each sub-frame contains a certain number of transform coefficients;

determining a norm for each of the sub-frames based on the sub-frame's rms;

quantizing the rms for each sub-frame;

normalizing the coefficients of each sub-frame by dividing each coefficient within the sub-frame by the quantized rms of the sub-frame;

using a first lattice vector quantizer to quantize coefficients at rates greater than 1 bit per coefficient; and using a second lattice vector quantizer to quantize coefficients at a rate of 1 bit per coefficient.

13. The method of claim 12, wherein the act of using a first lattice vector quantizer comprises:

constructing a codebook from a truncated lattice, wherein the lattice comprises a multi-dimensional lattice of all codevectors having integer coordinates with an even sum; and quantizing outlier source vectors lying outside of the truncated lattice.

14. The method of claim 12, wherein the act of using a second lattice vector quantizer comprises:

constructing a codebook from a lattice comprising a multi-dimensional lattice of all codevectors falling on concentric spheres; and quantizing source vectors.

15. The method of claim 12, further comprising:

variable bit-length coding indices of quantization for the coefficients quantized by the first lattice vector quantizer.

16. The method of claim 12, further comprising:

grouping the combined set of transform coefficients into sub-groups, wherein each subgroup contains sub-frames, and wherein each sub-frame contains a certain number of coefficients;

calculating an rms of one of the sub-frames;

normalizing the coefficients of the sub-frame by dividing each coefficient within the sub-frame with the rms of the sub-frame;

maintaining a Huffman coding flag for each sub-group;

maintaining a fixed number of bits for coding each sub-group;

calculating a number of bits necessary for using Huffman coding for a sub-group;

setting the Huffman flag and using Huffman coding if the number of bits necessary for using Huffman coding is less than the fixed number of bits for the sub-group; and clearing the Huffman flag and using fixed number of bit coding if the number of bits necessary for using Huffman coding is not less than the fixed number of bits for the sub-group.

17. A computer-readable storage medium having embodied thereon a program, the program being executable by a machine to perform any of the methods in claim 1, 5, 8, or 12.

18. A 22 kHz encoder for encoding an audio signal, the encoder comprising:

a transform module operable to transform a frame of time domain samples of the audio signal to frequency domain, forming a frame of transform coefficients;

a first lattice vector quantizer module operable to quantize transform coefficients at rates greater than 1 bit per coefficient; and a second lattice vector quantizer module operable to quantize transform coefficients at a rate of 1 bit per coefficient.

19. The encoder of claim 18 further comprising:

a coder module operable to variable bit-length code indices of quantization for the coefficients quantized by the first lattice vector quantizer.

20. An endpoint comprising:

an audio input/output interface;

a microphone communicably coupled to the audio input/output interface;

a speaker communicably coupled to the audio input/output interface; and a 22 kHz audio encoder communicably coupled to the audio input/output interface;

wherein the 22 kHz audio encoder comprises:

a transform module operable to transform a frame of time domain samples of an audio signal to frequency domain, forming a frame of transform coefficients;

a first lattice vector quantizer module operable to quantize coefficients at rates greater than 1 bit per coefficient; and a second lattice vector quantizer module operable to quantize coefficients at a rate of 1 bit per coefficient.

21. The endpoint of claim 20, wherein the 22 kHz audio encoder further comprises:

a coder module operable to variable bit-length code indices of quantization for the coefficients quantized by the first lattice vector quantizer.

22. The endpoint of claim 20, further comprising:

a bus communicably coupled to the audio input/output interface;

a video input/output interface communicably coupled to the bus;

a camera communicably coupled to the video input/output interface; and a display device communicably coupled to the video input/output interface.

* * * * *